United States Patent [19]

Waki et al.

[11] Patent Number: 4,920,042

[45] Date of Patent: Apr. 24, 1990

[54] COLOR IMAGE FORMING PROCESS COMPRISING DEVELOPING WITH SUBSTANTIALLY NO BENZYL ALCOHOL A MATERIAL HAVING SPECIFIC SENSITIZING DYES

[75] Inventors: Kokichi Waki; Masahiro Asami; Yoshinori Shibata, all of Kanagawa, Japan

[73] Assignee: Fuji Photo Film Co., Ltd., Kanagawa, Japan

[21] Appl. No.: 394,301

[22] Filed: Aug. 10, 1989

Related U.S. Application Data

[63] Continuation of Ser. No. 124,799, Oct. 20, 1987, abandoned.

[30] Foreign Application Priority Data

Feb. 20, 1986 [JP] Japan ..... 61-35748

[51] Int. Cl.[5] ..... G03C 7/30; G03C 7/32; G03C 1/12; G03C 1/14

[52] U.S. Cl. ..... 430/380; 430/383; 430/434; 430/464; 430/467; 430/558; 430/583; 430/585

[58] Field of Search ..... 430/380, 383, 434, 464, 430/467, 558, 567, 583, 585

[56] References Cited

U.S. PATENT DOCUMENTS

| | | | |
|---|---|---|---|
| 4,035,188 | 7/1977 | Tabata et al. | 430/467 |
| 4,299,914 | 11/1981 | Fujumastu et al. | 430/552 |
| 4,304,844 | 12/1981 | Fujumastu et al. | 430/552 |
| 4,336,321 | 6/1982 | Kanada et al. | 430/234 |
| 4,443,536 | 4/1984 | Lestina | 430/552 |
| 4,524,132 | 6/1985 | Aoki et al. | 430/552 |
| 4,526,861 | 7/1985 | Ichijima et al. | 430/385 |
| 4,529,690 | 7/1985 | Ohbayashi et al. | 430/551 |
| 4,564,590 | 1/1986 | Sasaki et al. | 430/552 |
| 4,565,777 | 1/1986 | Ogawa et al. | 430/552 |
| 4,618,573 | 10/1986 | Okamura et al. | 430/558 |
| 4,690,883 | 9/1987 | Kubodera et al. | 430/203 |

FOREIGN PATENT DOCUMENTS

| | | |
|---|---|---|
| 211437 | 2/1987 | European Pat. Off. . |
| 29461 | 8/1974 | Japan . |
| 52058 | 4/1980 | Japan . |
| 200037 | 12/1982 | Japan . |
| 31334 | 2/1983 | Japan . |
| 42095 | 3/1983 | Japan . |
| 50536 | 3/1983 | Japan . |
| 9653 | 1/1984 | Japan . |
| 48755 | 3/1984 | Japan . |
| 116646 | 7/1984 | Japan . |
| 140443 | 8/1984 | Japan . |
| 174836 | 10/1984 | Japan . |
| 177553 | 10/1984 | Japan . |
| 177554 | 10/1984 | Japan . |
| 177555 | 10/1984 | Japan . |
| 177556 | 10/1984 | Japan . |
| 177557 | 10/1984 | Japan . |
| 178459 | 10/1984 | Japan . |
| 19140 | 1/1985 | Japan . |
| 26338 | 2/1985 | Japan . |
| 26339 | 2/1985 | Japan . |
| 97353 | 5/1985 | Japan . |
| 158444 | 8/1985 | Japan . |
| 162256 | 8/1985 | Japan . |
| 158446 | 9/1985 | Japan . |
| 172042 | 9/1985 | Japan . |
| 70552 | 4/1986 | Japan . |
| 30250 | 2/1987 | Japan . |

*Primary Examiner*—Roland E. Martin
*Assistant Examiner*—Patrick A. Doody
*Attorney, Agent, or Firm*—Sughrue, Mion, Zinn, Macpeak & Seas

[57] ABSTRACT

A color image-forming process of developing a color photographic paper having on a support silver halide emulsion layer(s) containing a monodispersed silver chlorobromide emulsion having a deviation coefficient of not more than 20% and a color coupler, said emulsion being spectrally sensitized by at least one of the compounds represented by general formulae (I), (II), (III) and (IV) defined in this invention, using a color developer containing substantially no benzyl alcohol for a period of time of not more than 2 minutes and 30 seconds.

In processing the aforesaid color photographic paper, even when the color paper is procesed using a color developer containing no benzyl alcohol, which caused pollution problems, in a short processing time of not more than 2 minutes and 30 seconds, stable color images having less formation of fog and high color density are obtained.

20 Claims, No Drawings

COLOR IMAGE FORMING PROCESS COMPRISING DEVELOPING WITH SUBSTANTIALLY NO BENZYL ALCOHOL A MATERIAL HAVING SPECIFIC SENSITIZING DYES

This is a continuation of application Ser. No. 124,799, filed Oct. 20, 1987, now abandoned.

TECHNICAL FIELD

This invention relates to a color image forming process and, more particularly, to a color image forming process for silver halide color photographic materials. More specifically, the invention relates to a color image forming process for silver halide color photographic materials giving less fog, showing stable processing performance, and capable of performing quick processing.

BACKGROUND ART

For forming color images, there is known a process wherein three kinds of yellow, magenta, and cyan couplers are incorporated in light-sensitive emulsion layers, respectively, of a color photographic material and after imagewise exposing the color photographic material, processing it with a color developer containing an aromatic primary amine color developing agent, the oxidation product of which forms colored dyes by coupling reaction with the couplers. In this case, it is important to color a color photographic material containing silver halide in the smallest possible amount at a high efficiency in a limited development time.

For attaining an efficient coloration, it is necessary that the development of silver halide is proceeded as quick as possible without leaving the silver halide to be developed as it is. Also, it is important that in such a manner of development the oxidation products of the color developing agent are allowed to usefully react with the color couplers. For this purpose, it is known to use a silver halide showing high developing speed or a silver halide having high developing rate. A silver chloride emulsion or a silver chlorobromide emulsion is actually used for this purpose. Also, it is known that when such a silver halide cannot be used by some reasons, coloring is quickened and increased by increasing the coating amount of silver halide for the amount of color couplers. Furthermore, it is effective to use couplers having high coupling speed and to increase the developing activity of a color developer itself. Various methods have been proposed for increasing the development speed and coloring speed of a color developer. In these methods, it is necessary for forming dyes by the final coupling reaction of a color developing agent and couplers that the color developing agent itself enters coupler-dispersed oil drops. As additives for quickening the permeation of the color developing agent for accelerating coloring, various kinds of additives are known. As the additive having particularly high coloring accelerating effect, benzyl alcohol is known and it has hitherto been used for processing various kinds of color photographic materials and is widely used at present for processing color photographic papers.

Benzyl alcohol is poor in solubility in water, although it may be dissolved in water to some extent and, hence, for increasing the solubility thereof, it has been widely performed to use diethylene glycol, triethylene glycol or alkanolamine.

These compounds and benzyl alcohol itself, however, give a large load of pollution in processing waste solutions and give high BOD value and COD value and, hence, in spite of having the above-described advantages of improving coloring property of color developer and improving the solubility, it has been desired to reduce or eliminate benzyl alcohol from the point of waste solution disposal.

Furthermore, even when the aforesaid solvent such as diethylene glycol, etc., is used, the solubility of benzyl alcohol is yet insufficient and, hence, the existence of benzyl alcohol causes troubles in preparing color developer.

Also, if benzyl alcohol in color developer is carried over into a succeeding bath, i.e., a bleach bath or a blix bath, together with the color developer and accumulated therein, it causes the formation of a leuco compound of cyan dye according to the kind of cyan dye to reduce coloring density. Furthermore, the accumulation of benzyl alcohol makes it insufficient to wash out the developer components, in particular, color developing agent in wash step, which results in the deterioration of the storage stability of color images caused by the residues.

From the various viewpoints described above, it is very significant to reduce or eliminate benzyl alcohol in color developer.

In addition to the aforesaid problems, color laboratories are at present required to shorten the processing time in a trend of shortening the time for finish delivery of color prints.

A process of processing a silver halide photographic material containing cyan, magenta and yellow couplers having specific groups introduced thereto with a color developer containing no benzyl alcohol for 3 minutes is disclosed in Japanese Patent Application (OPI) Nos. 174836/84 and 177553/84 (the term "OPI" as used herein refers to a "published unexamined Japanese patent application"). However, the development of a new quick processing process giving loss reduction of coloring density and less formation of fog even by rapidly processing color photographic materials with a color developer containing no benzyl alcohol for a color development time of less than 2 minutes and 30 seconds has been desired.

The object of this invention is, therefore, to provide a color image forming process giving less reduction of coloring density even by processing color photographic materials with a color developer containing substantially no benzyl alcohol in a short period of time of not more than 2 minutes and 30 seconds, and, in particular, the object of this invention is to provide a color image forming process using a color photographic materials which give less fog and are stable when processed under the aforesaid development conditions.

DISCLOSURE OF INVENTION

The object of this invention is attained in the following manner.

That is, the invention is a color image forming process, which comprises after imagewise exposing a silver halide color photographic material having on a reflective support at least one light-sensitive emulsion layer containing at least one kind of monodispersed silver chlorobromide emulsion and a color coupler, said emulsion having been spectrally sensitized by at least one of compounds represented by the following general formulae (I), (II), (III) and (IV) containing substantially no silver iodide, containing silver chloride in an amount of from 60 mol % to less than 80 mol % of the total silver halide amount, and having a coefficient of deviation of not more than 20%, developing the color photographic material using a color developer containing substantially no benzyl alcohol within a development time of 2 minutes and 30 seconds:

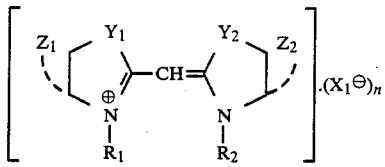

(I)

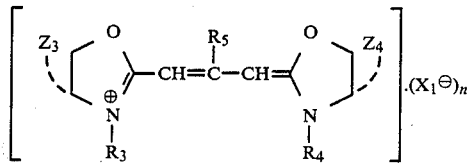

(II)

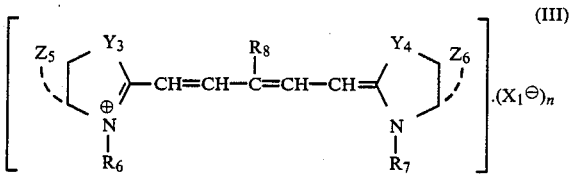

(III)

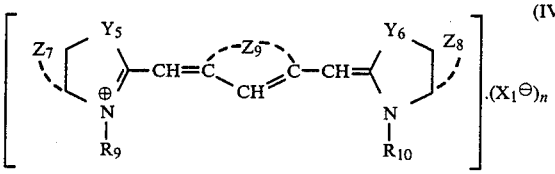

(IV)

wherein $Z_1$, $Z_2$, $Z_5$, $Z_6$, $Z_7$ and $Z_8$ each represents an atomic group necessary for forming a benzene ring or a naphthalene ring condensed to a thiazole ring or a selenazole ring, said benzene ring or said naphthalene ring may be substituted; $Z_3$ and $Z_4$ each represents an atomic group necessary for forming a benzene ring or a naphthalene ring condensed to an oxazole ring, said benzene ring or said naphthalene ring may be substituted; $Z_9$ represents a hydrocarbon atomic group necessary for forming a 6-membered ring; $R_1$, $R_2$, $R_3$, $R_4$, $R_6$, $R_7$, $R_9$ and $R_{10}$ each represents an alkyl group, an alkenyl group, or an aryl group, said groups may be substituted; $R_5$ and $R_8$ each represents a hydrogen atom or an alkyl group having 1 to 3 carbon atoms; $Y_1$, $Y_2$, $Y_3$, $Y_4$, $Y_5$ and $Y_6$ each represents a sulfur atom or a selenium atom; $X_1\theta$ represents an anion; and n represents 0 or 1.

In a preferred embodiment of this invention, the silver halide color photographic material has at least one each of blue-sensitive emulsion layer, green-sensitive emulsion layer, and red-sensitive emulsion layer as light-sensitive emulsion layers, said blue-sensitive emulsion layer containing the aforesaid mono-dispersed silver chlorobromide emulsion spectrally sensitized by at least one of compounds represented by general formula (I) described above, said green-sensitive emulsion layer containing the aforesaid monodispersed silver chlorobromide emulsion spectrally sensitized by at least one of compounds represented by general formula (II) described above, and said red-sensitive emulsion layer containing the aforesaid monodispersed silver chlorobromide emulsion spectrally sensitized by one of compounds represented by general formula (III) and/or general formula (IV) described above.

Also, in a more preferred embodiment of this invention, the light-sensitive emulsion layer containing the aforesaid monodispersed silver chlorobromide emulsion spectrally sensitized by compounds represented by general formula (II) described above contains at least one of compounds represented by general formula (V):

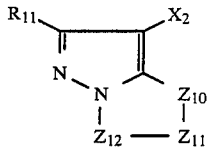

(V)

wherein $R_{11}$ represents a hydrogen atom or a substituent; $X_2$ represents a hydrogen atom or a group capable of being removed by a coupling reaction with the oxidation product of an aromatic primary amine developing agent; $Z_{10}$, $Z_{11}$ and $Z_{12}$ each represents a methine, a substituted methine, =N—, or —NH—; one of $Z_{10}$–$Z_{11}$ bond and $Z_{11}$–$Z_{12}$ bond is a double bond and the other is a single bond; when $Z_{11}$–$Z_{12}$ is a carbon-carbon double bond, the double bond may be a part of an aromatic ring; the compound of general formula (V) includes the case that it forms a dimer or higher polymer at $R_{11}$ or $X_2$; and also when $Z_{10}$, $Z_{11}$ or $Z_{12}$ is a substituted methine, the compound includes the case that it forms a dimer or higher polymer with the substituted methine.

The term "containing substantially no benzyl alcohol" in this invention means that the concentration of benzyl alcohol is less than 1 ml/l, in particular, less than 0.5 ml/l. It is preferred that the color developer contains no benzyl alcohol.

It is known that silver chloride is developed faster than silver bromide. It can be sufficiently assumed that by utilizing the aforesaid fact, quick processing is easily made by using a silver halide emulsion having an increased silver chloride content. Quick processing by a silver chlorobromide emulsion having increased silver chloride content is mentioned in Japanese Patent Application (OPI) Nos. 95736/83, 08533/83 and 125612/83. However, the techniques disclosed in these patent applications are not an improvement in a technique itself for performing quick processing using such as high silver chloride-containing emulsion but are techniques for silver halide emulsions relating to the reversing property of emulsion, the formation of fog, or reproducibility of chemical sensitization, which is also a problem encountered in conventional processing.

The present invention is a technique relating to quick processing itself or is a technique relating to a color image forming process by the aforesaid technique. As described above, the elimination of benzyl alcohol from a color developer gives advantages on the preparation of the developer, treatment of waste solution, etc., but at the same time, it gives disadvantage of reducing coloring density. The inventors have now found that, when benzyl alcohol is omitted from color developer, not only the coloring density at gradation portion and Dmax portion but also the coloring density of fog are reduced, and that the reduction of coloring density is greatly caused by the fact that coloring by coupling does not efficiently occur although silver halide grains having fogged nuclei have been developed as well as the fact that the number of fogged silver halide grains to be developed is reduced.

In other words, part of silver halide grains contributed as grains forming fog in a color developer containing benzyl alcohol becomes grains forming no fog in a color developer containing no benzyl alcohol. This fact is surprising on comparing other fact, confirmed by the inventors, that in a silver halide light-sensitive material containing no color couplers, the number of fogged silver halide grains does not change regardless of the presence of benzyl alcohol in color developer.

As the result of intensive investigations based on the aforesaid matters, the inventors have succeeded n making an invention of a color forming process capable of quickly processing silver halide color photographic materials.

As described above, a silver chlorobromide emulsion having a high silver chloride content shows a high development speed and is suitable for quick processing but, at the same time, is liable to form fog. The fog is considered to be caused by silver halide grains already having fogged nuclei before development and silver halide grains newly forming fogged nuclei at development, and that fog is reduced by processing a silver halide color photographic material containing color couplers is considered to be caused by the reduction of one of fogs by the aforesaid two reasons. Accordingly, it can be said that by processing a silver halide photographic material containing a silver chlorobromide emulsion having a high silver chloride content with a color developer containing no benzyl alcohol, quick processing can be attained without forming fog.

The silver halide emulsion for use in this invention is a monodispersed silver chlorobromide emulsion containing from 60 mol % to less than 80 mol % silver chloride and containing substantially no silver iodide. The term "containing substantially no silver iodide" means that the content of silver iodide is 1 mol % or less, preferably 0.5 mol % or less, and more preferably the content is zero. Containing of silver iodide is undesirable since it lowers a development speed and in some cases increases fog.

Also, if the content of silver chloride is less than 60 mol %, the increase of development speed is insufficient for quick processing and if the content of silver chloride is 80 mol % or more, the stability for processing is inferior to the case of containing less than 80 mol % silver chloride although the formation of fog is restrained lower without using a method disclosed in Japanese Patent Application (OPI) Nos. 97736/83, 108533/83 and 125612/83. In this invention, it is more preferred to use a silver chlorobromide emulsion containing from 65 mol % to 78 mol % silver chloride.

The silver halide emulsion for use in this invention is monodispersed in grain size distribution. The term "monodispersed" means that the value (coefficient of deviation) obtained by dividing a standard deviation in the case of statistically showing diameters corresponding to spheres by a mean sphere equivalent diameter (mean grain size) is not more than 20%, preferably not more than 15%, and more preferably not more than 10%. If a grain size distribution in a silver halide emulsion having a high silver chloride content is broad, in particular, if the emulsion contains a large amount of small grains, the deviation of the photographic performance to the deviation of processing factors undesirably increases.

The mean grain size of the silver halide emulsion which can be preferably used in this invention is from 0.003 $\mu m^3$ to 8 $\mu m^3$, more preferably from 0.015 $\mu m^3$ to 4 $\mu m^3$, and most preferably from 0.03 $\mu m^3$ to 2 $\mu m^3$, as calculated in volume.

The silver halide grains for use in this invention may have different phases at the inside thereof and on the surface layer thereof, may have a multiphase structure having junction structure, and may be composed of a homogeneous phase throughout the whole grain. Also, the silver halide grains may be composed of a mixture of these grains.

The silver halide grains for use in this invention may have a regular crystal form such as cubic, octahedral, dodecahedral, tetradecahedral, an irregular form such as spherical, etc. or a composite form of these crystal forms. Also, the silver halide grains may be tabular grains and, in this case, a tabular grain silver halide emulsion wherein tabular silver halide grains having the ratio of length/thickness of at least 5, and a preferably at lesat 8, account for at least 50% of the total projected area of the silver halide grains can be used in this invention. A mixture of these silver halide emulsions each containing silver halide grains having different crystal forms may also be used. The silver halide emulsion may be of a surface latent image type of forming latent images mainly on the surface thereof or of an internal latent image type of forming latent images mainly in the inside of the grains.

The silver halide photographic emulsions for use in this invention can be prepared according to the method described in P. Glafkides, *Chimie et Physique Photographique,* published by Paul Montel, 1967; G. F. Duffin, *Photographic Emulsion Chemistry,* published by Focal Press, 1966; and V. L. Zelikman et al., *Making and Coating Photographic Emulsion,* published by Focal Press, 1964, etc.

That is, the emulsion can be prepared by an acid method, a neutralization method, an ammonia method, etc., and as a method of reacting a soluble silver salt and a soluble halide, a single jet method, a double jet method, or a combination thereof may be employed. A so-called reverse mixing method of forming silver halide grains in the existence of excess silver ions can also be used. As one system of the double jet method, a so-called controlled double jet method of keeping a constant pAg in a liquid phase of forming silver halide grains can also be used. According to the method, a silver halide emulsion containing silver halide grains having a regular crystal form and substantially uniform grain sizes can be obtained.

Furthermore, a silver halide emulsion prepared by a conversion method including a step of converting a silver halide already formed before finishing the formation of the silver halide grains into a silver halide having small solubility product or a silver halide emulsion to which the similar halogen conversion was applied after finishing the formation of the silver halide grains can also be used in this invention.

During the formation or physical ripening of the silver halide grains, a cadmium salt, a zinc salt, a thallium salt, an iridium salt or a complex salt thereof, a rhodium salt or a complex salt thereof, an iron salt or a complex salt thereof, etc., may exist in the system.

After the formation of the silver halide grains silver halide emulsions are usually physically ripened, desalter, and chemically ripened before coating.

The known silver halide solvents (e.g., ammonia, potassium rhodanate, and thioethers and thione compounds described in U.S. Pat. No. 3,271,157, Japanese Patent Application (OPI) Nos. 12360/76, 82408/78, 144319/78, 10017/79, 155828/79, etc.) can be used for the precipitation, physical ripening, and chemical ripening of the silver halide emulsions for use in this invention.

For removing soluble salts from silver halide emulsions after physical ripening, a noodle washing method, a flocculation method, or an ultrafiltration method can be employed.

The silver halide emulsions for use in this invention can be chemically sensitized by a sulfur sensitization method using active gelatin or a sulfur-containing compound capable of reacting with silver (e.g., thiosulfates, thioureas, mercapto compounds, rhodanines, etc.); a reduction sensitization method using a reducing compound (e.g., stannous salts, amines, hydrazine derivatives, formamidinesulfinic acid, silane compounds, etc.); a noble metal sensitization method using a metal compound (e.g., gold complex salts and complex salts of metals belonging to group VIII of the Periodic Table, such as Pt, Ir, Pd, Rh, Fe, etc.), or a combination thereof.

In the aforesaid chemical sensitizations, the use of the sulfur sensitization alone is more preferred.

In this invention, two or more kinds of mono-dispersed silver halide emulsions (preferably having the aforesaid coefficient of deviation) having different grain sizes can be used for one layer or two or more layers in a silver halide emulsion layer having substantially the same color sensitivity for satisfying the gradation aimed by the color photographic material for use in this invention. Furthermore, two or more kinds of polydispersed silver halide emulsions or a combination of the mono-dispersed silver halide emulsion and a poly-dispersed silver halide emulsion can be used in one layer as a mixture thereof or for two or more layers.

For applying the silver halide emulsions in this invention to color photographic materials, it is necessary to spectrally sensitize the emulsions for obtaining desired color sensitivities.

In this invention, by processing a silver halide color photographic material containing a silver chlorobromide emulsion containing from 60 mol % to less than 80 mol % silver chloride and containing substantially no silver iodide with a color developer containing substantially no benzyl alcohol, quick processing without being accompanied by the formation of fog can be applied as described above and in the course of the investigations for finding the aforesaid fact, it has been clarified that the extent of fog formation at processing and the development rate are greatly influenced by the kind of the spectral sensitizing dye used. That is, it has been found that according to the spectral sensitizing dye used, there are cases that fog forms and the effect for improving development speed is insufficient even in the case of processsing the above-described silver halide emulsion with a color developer containing no benzyl alcohol.

In view of the aforesaid points, the inventors have made intensive investigations and found that, by processing a silver halide color photographic material containing monodispersed silver halide emulsion(s) spectrally sensitized by at least one of the compounds represented by general formulae (I), (II), (III) and (IV) described above, containing from 60 mol % to less than 80 mol % silver chloride, and containing substantially no silver iodide, a color image formation with the formation of fog restrained greatly and with excellent developing speed becomes possible.

The compounds shown by general formulae (I) to (IV) described above will be explained in detail.

In general formulae (I), (II), (III) and (IV) described above, $Z_1$, $Z_2$, $Z_5$, $Z_6$, $Z_7$ and $Z_8$ each represents an atom necessary for forming a benzene ring or a naphthalene ring each condensed to a thiazole ring or a selenazole ring, and each of the rings may be substituted by a halogen atom such as a fluorine atom, a chlorine atom, a bromine atom, an iodine atom, etc., a hydroxyl group, an alkyl group such as a methyl group, an ethyl group, a propyl group, a butyl group, etc., an alkoxy group such as a methoxy group, an ethoxy group, etc., an aryl group such as a phenyl group, a hydroxyphenyl group, etc., an alkoxycarbonyl group such as a methoxycarbonyl group, an ethoxycarbonyl group, etc., a cyano group, a nitro group, etc.

In these substituents, a halogen atom, an alkoxy group or an aryl group is preferred in this invention and in a halogen atom, a chlorine atom is particularly preferred, in an alkoxy group, a methoxy group is particularly preferred, and in an aryl group, a phenyl group is particularly preferred.

Also, $Z_3$ and $Z_4$ in the aforesaid formulae represents an atomic group necessary for forming a benzene ring or a naphthalene ring condensed to an oxazole ring and each of the rings may be substituted by a halogen atom such as a fluorine atom, a chlorine atom, a bromine atom, an iodine atom, etc., a hydroxyl group, an alkoxy group such as a methyl group, an ethyl group, a propyl group, an ethoxy group, etc., an aryl group such as a phenyl group, a hydroxyphenyl group, etc., an alkoxycarbonyl group such as a methoxycarbonyl group, an ethoxycarbonyl group, etc., a cyano group, a nitro group, etc.

In these substituents, a halogen atom, an alkoxy group, or an aryl group is preferred in this invention, and as a halogen atom, a chlorine atom is particularly preferred, as an alkoxy group, a methoxy group is particularly preferred, and as an aryl group, a phenyl group is particularly preferred.

$Z_9$ represents a hydrocarbon atomic group necessary for forming a 6-membered ring such as, preferably, a dimethylcyclohexene ring.

In general formulae (I), (II), (III) and (IV) described above, $R_1$, $R_2$, $R_3$, $R_4$, $R_6$, $R_7$, $R_9$ and $R_{10}$ each represents an alkyl group, an alkenyl group, an aralkyl group, or an aryl group and these groups may be substituted by a hydroxyl group, a sulfone group or a carboxyl group. Preferred examples of the aforesaid groups are a methyl group, an ethyl group, an n-propyl group, an i-propyl group, an n-butyl group, a hydroxymethyl group, a hydroxyethyl group, a hydroxypropyl group, a sulfoethyl group, a sulfopropyl group, a sulfobutyl group, a carboxymethyl group, a carboxyethyl group, a benzyl group, a phenethyl group, a propenyl group, etc.

In these substituents, an alkyl group having 1 to 5 carbon atoms, a sulfoalkyl group having 2 to 4 carbon atoms, a carboxyalkyl group having 2 to 5 carbon atoms, or an aralkyl group is particularly preferred in this invention.

Also, $R_5$ and $R_8$ each represents a hydrogen atom or an alkyl group having 1 to 3 carbon atoms.

In general formulae (I), (II), (III) and (IV), $Y_1$ to $Y_6$ each represents a sulfur atom or a selenium atom and $X^{\ominus}$represents an anion, and n represents 0 or 1, when n is 0, the compound of the formula forms an intramolecular salt.
Specific examples of the compound shown by general formula (I) are illustrated below but the invention is not limited to these compounds.
(I-1)
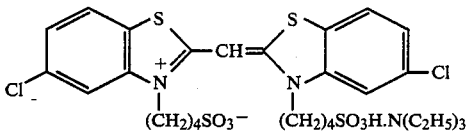
(I-2)
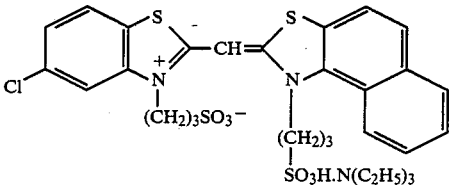
(I-3)
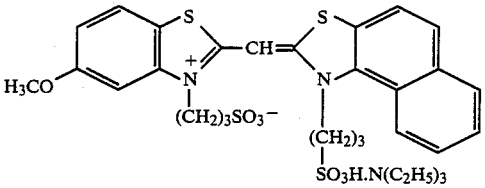
(I-4)
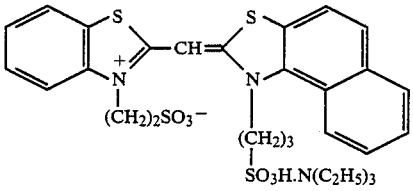
(I-5)
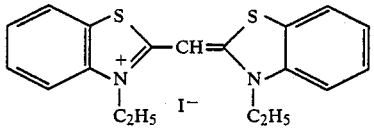
(I-6)
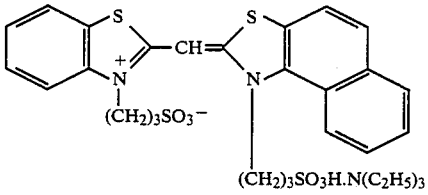
(I-7)
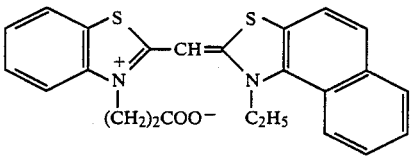
(I-8)
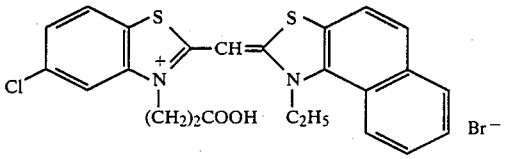
-continued
(I-9)
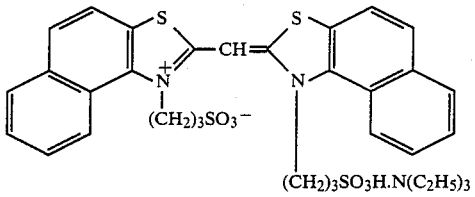
(I-10)
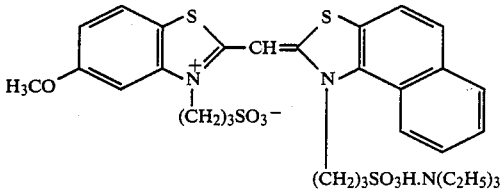
(I-11)
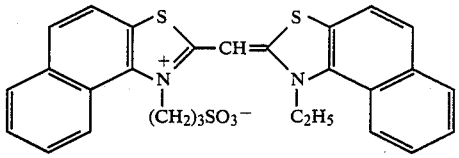
(I-12)
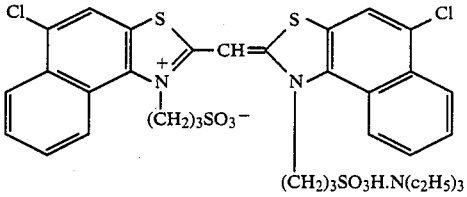
(I-13)
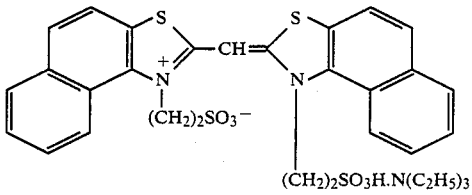
(I-14)
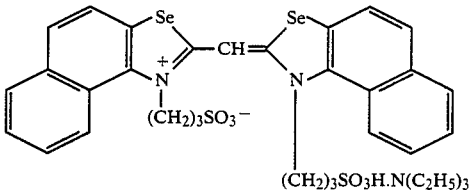
(I-15)
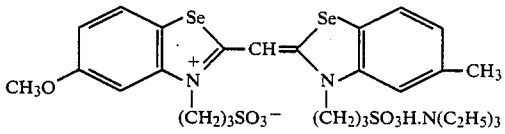
(I-16)
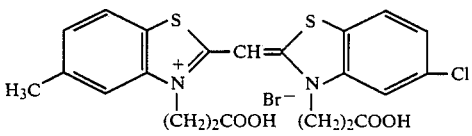

-continued
(I-17)
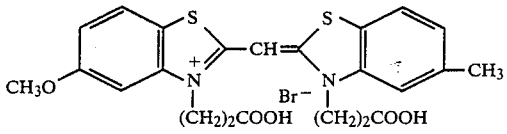
-continued
(I-18)
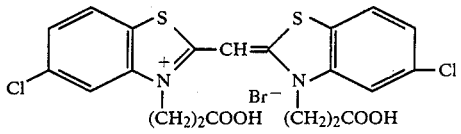
Specific examples of the compound shown by general formula (II) are illustrated below but the invention is not limited to these compounds.
(II-1)
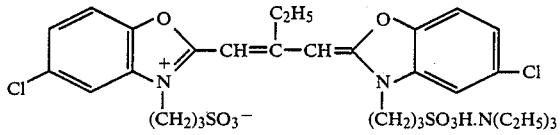
(II-2)
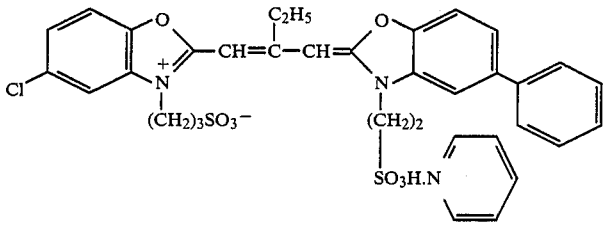
(II-3)
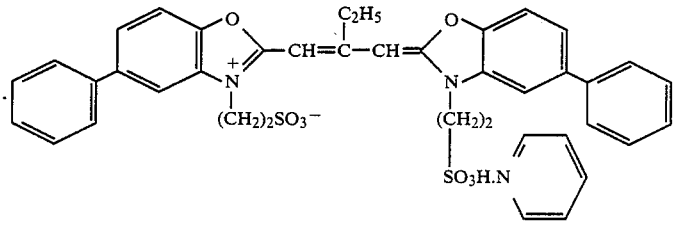
(II-4)
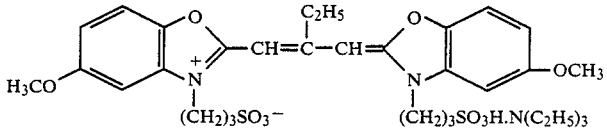
(II-5)
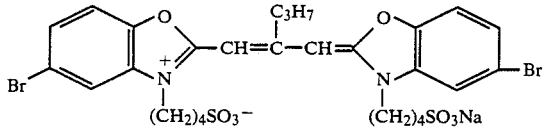
(II-6)
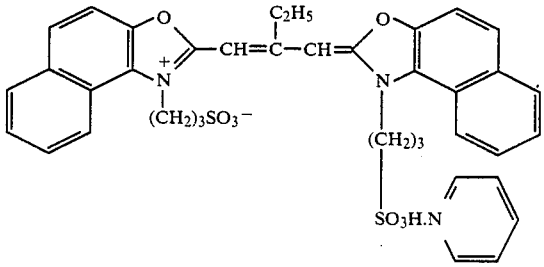

-continued
(II-7)
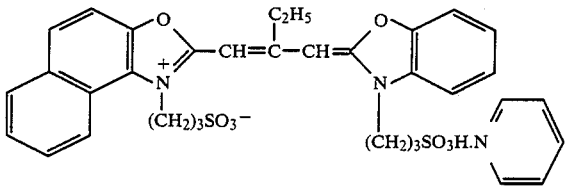
(II-8)
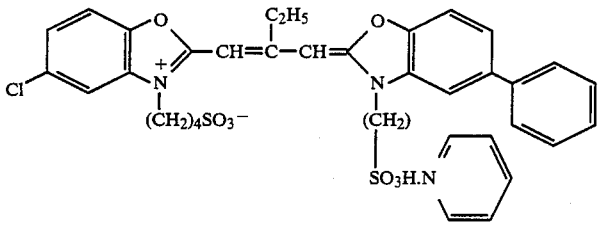
(II-9)
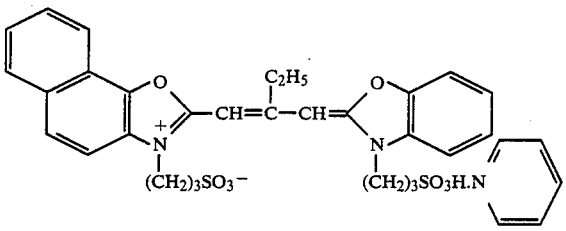
(II-10)
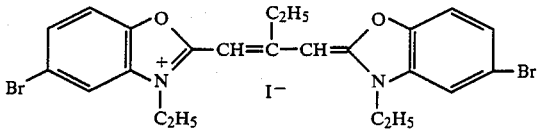
Specific examples of the compound shown by general formula (III) are illustrated below but the invention is not limited to these compounds.
(III-1)
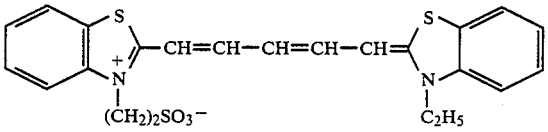
(III-2)
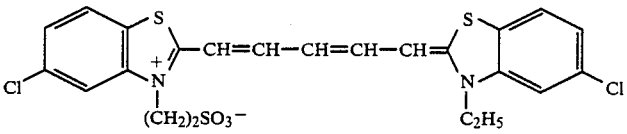
(III-3)
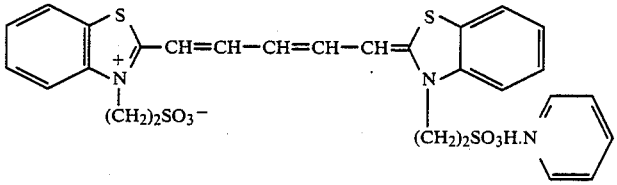
(III-4)
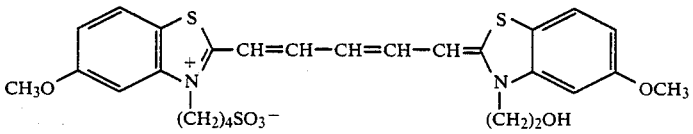

-continued
(III-5)
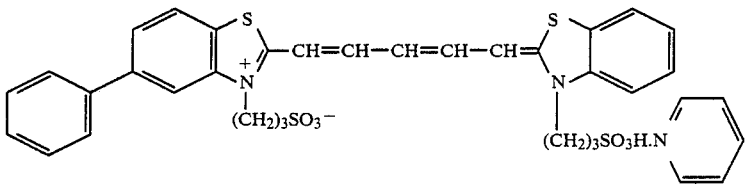
(III-6)
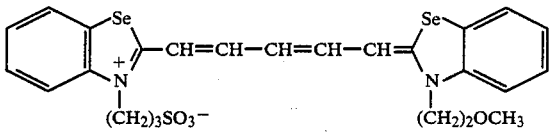
(III-7)
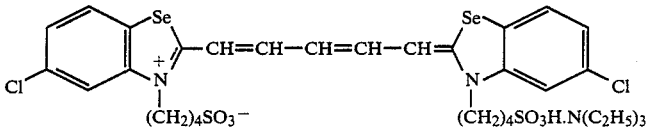
(III-8)
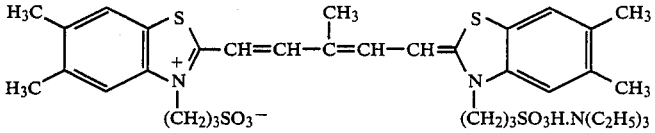
(III-9)
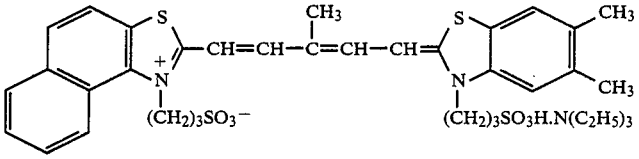
(III-10)
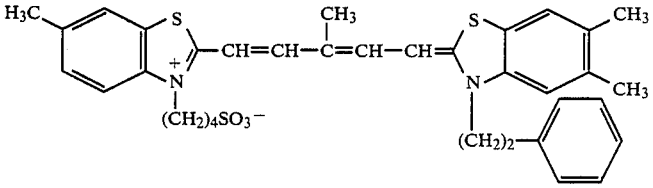
(III-11)
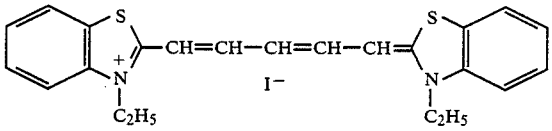
(III-12)
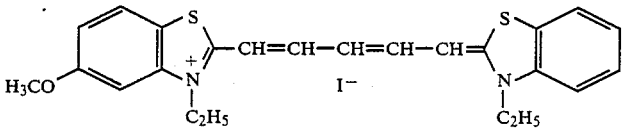
(III-13)
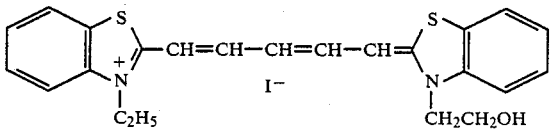
Specific examples of the compound shown by general formula (IV) are illustrated below but the invention is not limited to these compounds.

(IV-1)
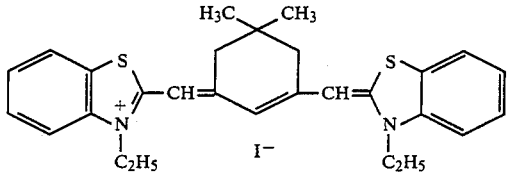
(IV-2)
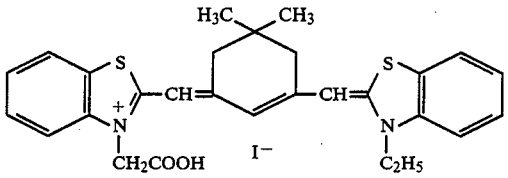
(IV-3)
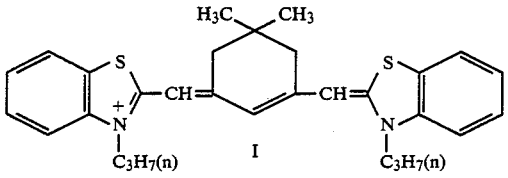
(IV-4)
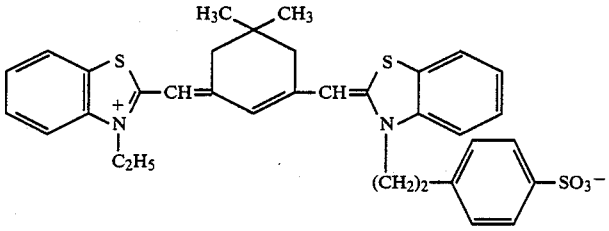
(IV-5)
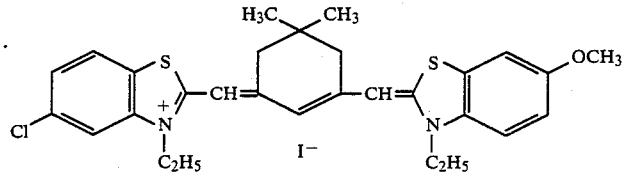
(IV-6)
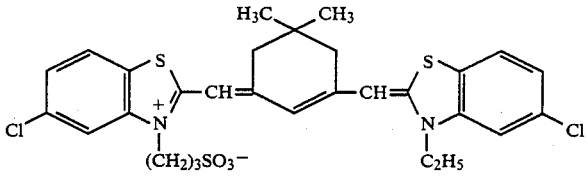
(IV-7)
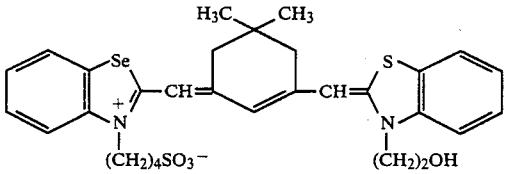
(IV-8)
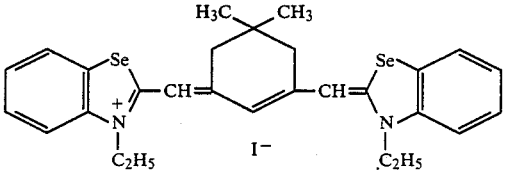

-continued (IV-9)

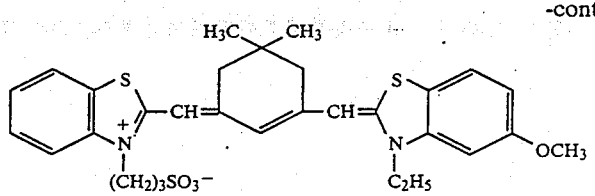

(IV-10)

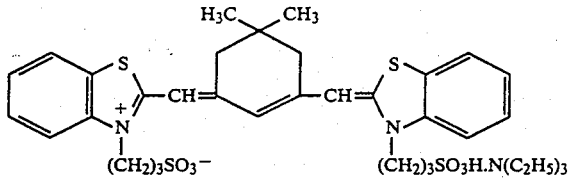

(IV-11)

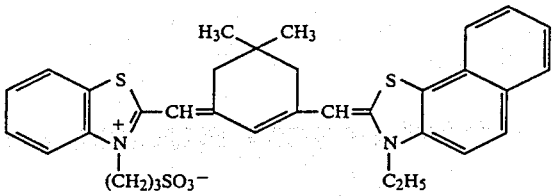

The added amount of the compound shown by general formula (I), (II), (III) or (IV) described above varies widely case by case but is in the range of from $1.0\times10^{-6}$ mol to $5.0\times10^{-2}$ mol, and preferably in the range of from $1.0\times10^{-5}$ mol to $1.0\times10^{-2}$ mol per mol of silver halide.

For spectrally sensitizing a silver halide emulsion with the aforesaid compound in this invention, well-known ordinary method may be used. That is, the compound may be directly dispersed in a silver halide emulsion or the compound may be added to a silver halide emulsion as a solution in a proper solvent (e.g., methanol, ethanol, ethyl acetate, methyl cellosolve, acetone, fluorinated alcohol, or a mixture thereof). Furthermore, a method of dissolving the compound in a volatile organic solvent, dispersing the solution in an aqueous hydrophilic colloid solution, and adding the dispersion to a silver halide emulsion as described in U.S. Pat. No. 3,469,987 may be used.

The addition of the aforesaid compound can be performed in any step for the preparation of a silver halide emulsion. For example, the compound is added before, during, or after the formation of silver halide grains, before, during, or after chemical ripening of silver halide grains, or at the time of the preparation of a coating composition for a light-sensitive emulsion layer. In this invention, it is preferred to add the compound after the formation of silver halide grains, before chemical ripening, during chemical ripening, or after chemical ripening.

It is necessary that the light-sensitive emulsion layers of a color photographic light-sensitive material for use in this invention contain color couplers for forming color images. A color coupler in this invention is a compound capable of forming a colored dye by causing coupling reaction with the oxidation product of an aromatic primary amine developing agent. Typical examples of these preferred color couplers are yellow coloring couplers selected from open chain or heterocyclic ketomethylene compounds, magenta coloring couplers selected from pyrazolone series and pyrazoloazole series compounds, and cyan coloring couplers selected from naphtholic and phenolic compounds.

It is clear that for forming color images with less reduction in coloring density even in the case of applying processing of short period of time using a color developer containing substantially no benzyl alcohol, the selection of these color couplers is also an important factor in addition to the techniques of silver halide emulsions and the spectral sensitization for these emulsions as described above.

According to the result of the inventors' investigations, it has newly been clarified that when the color couplers illustrated above as typical examples are applied to a color photographic material in this invention and the color photographic material is processed in a short period of time by a color developer containing substantially no benzyl alcohol, these color couplers show good coloring property and, in particular, pyrazoloazole series compounds are specifically excellent in coloring property.

The pyrazoloazole series magenta couplers are the compounds shown by general formula (V) described hereinbefore.

A polymer in general formula (V) means a compound having two or more groups shown by general formula (V) in one molecule and bis compounds and polymer couplers are included in the polymer.

The polymer coupler may be a homopolymer composed of only a monomer (preferably, having a vinyl group, hereinafter, the monomer is referred to as vinyl monomer) having a moiety shown by general formula (V) described above or may be a copolymer composed of the aforesaid vinyl monomer and a non-coloring ethylenically unsaturated monomer which does not cause coupling with the oxidation product of an aromatic primary amine developing agent.

The compound shown by general formula (V) described above is a 5-membered ring-5-membered ring-condensed nitrogen-containing heterocyclic ring type coupler, its coloring mother nucleus shows an aromaticity equivalent to naphthalene, and has a chemical structure usually called azapentalene.

Preferred examples of the couplers shown by general formula (V) are 1H-imidazo[1,2-b]pyrazoles, 1H-pyrazolo[1,5-b]pyrazoles, 1H-pyrazolo[5,1-c][1,2,4]- triazoles, 1H-pyrazolo[1,5-b][1,2,4]triazoles, 1-H-pyrazolo[1,5-d]tetrazoles, and 1H-pyrazolo[1,5-a]benzimidazoles, which are represented by general formulae (VI), (VII), (VIII), (IX), (X) and (XI) described below, respectively. Of these compounds, preferred compounds are those shown by general formulae (VI), (VIII) and (IX), and particularly preferred compounds are those shown by general formulae (VI( and (IX).

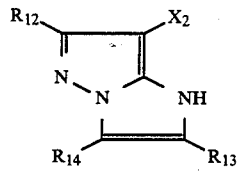
(VI)

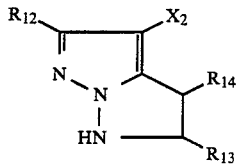
(VII)

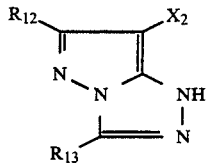
(VIII)

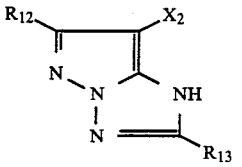
(IX)

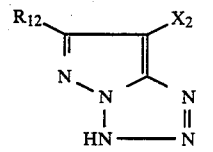
(X)

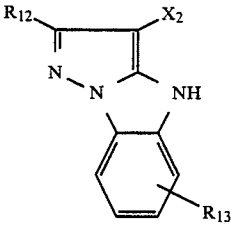
(XI)

In general formulae (VI) to (XI), $R_{12}$, $R_{13}$ and $R_{14}$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; and $X_2$ represents a hydrogen atom, a halogen atom, a carboxyl group or a group which is bonded to a carbon atom at the coupling position through an oxygen atom, a nitrogen atom or a sulfur atom and causes coupling releasing.

The case of forming a divalent group by $R_{12}$, $R_{13}$, $R_{14}$ or $X_2$ and forming a bis compound by the divalent group is also included in the compounds shown by general formulae (VI) to (XI).

When the moiety shown by general formula (XI) exists in the vinyl monomer, $R_{12}$, $R_{13}$ or $R_{14}$ represents a siple bond or a linkage group, through which the moiety shown by general formulae (VI) to (XI) is bonded to a vinyl group.

More particularly, $R_{12}$, $R_{13}$ and $R_{14}$ each represents a hydrogen atom, a halogen atom (e.g., a chlorine atom, a bromine atom, etc.), an alkyl group (e.g., a methyl group, a propyl group, a t-butyl group, a trifluoromethyl group, a tridecyl group, a 3-(2,4-di-t-amylphenoxy)propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-t-butylphenyl group, a 2,4-di-t-amylphenyl group, a 4-tetradecanamidophenyl group, etc.), a heterocyclic group (e.g., a furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-t-amylphenoxy)-butyramido group, a Y-(3-t-butyl-4-hydroxyphenoxy)-butyramido group, an α-[4-(4-hydroxyphenylsulfonyl)-phenoxy]decanamido group, etc.), an anilino group (e.g., a phenylamino group, a 2-chloroanilino group, a 2-chloro5-tetradecanamidoanilino group, a 2-chloro-5-dodecyloxycarbonylanilino group, an N-acetylanilino group, a 2-chloro-5-[α-(3-t-butyl-4-hydroxyphenoxy)-dodecanamido]-anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butyl-phenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)-propyl] carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecylcarbonyl group, an octadecylcarbonyl group, etc.), or an aryloxycarbonyl group (e.g., a phenyloxycarbonyl group, a 3-pentadecyloxycarbonyl group, etc.); and X represents a hydrogen atom, a halogen atom (e.g., a chlorine atom, a bromine atom, an iodine atom, etc.), a carboxyl group, a group bonding by an oxygen atom (e.g., an acetoxy group, a propanoyloxy group, a benzyloxy group, a 2,4-dichlorobenzoyloxy group, an ethoxyoxaloyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethox group, a benzyloxy group, a 2-phenethyloxy group, a 2-phenoxyethoxy group, a 5-phenyltetrazolyloxy group, a 2-benzothiazolyloxy group, etc.), a group bonding by a nitrogen atom (e.g., a benzenesulfonaido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzylethoxy-3-hydantoinyl group, a 2N-1,1-dioxo-3(2H)-oxo-1,2-benzisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.), or a group bonding by a sulfur atom (e.g., a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

When $R_{12}$, $R_{13}$, $R_{14}$ or $X_2$ is a divalent group and a bis compound is formed by the divalent group, the details of the divalent group are as follows. That is, the divalent group represents a substituted or unsubstituted alkylene group (e.g., a methylene group, an ethylene group, a 1,10-decylene group, $—CH_2CH_2—O—CH_2CH_2—$, etc.), a substituted or unsubstituted phenylene group (e.g., a 1,4-phenylene group, a pb 1,3-pheylene group,

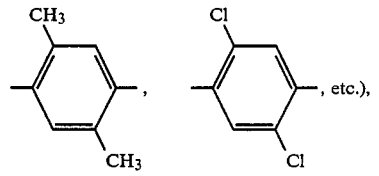

or $—NHCO—R_{15}—CONH—$ (wherein $R_{15}$ represents a substituted or unsubstituted alkylene or phenylene group).

The linking group shown by $R_{12}$, $R_{13}$ or $R_{14}$ in the case that the compound shown by general formulae (VI) to (XI) is in the vinyl monomer includes a group formed by a combination of the groups selected from alkylene groups (substituted or unsubstituted alkylene groups such as a methylene group, an ethylene group, a 1,10-decylene group, $—CH_2CH_2OCH_2—$, etc.), phenylene groups (substituted or unsubstituted phenylene groups such as a 1,4-phenylene group, a 1,3-phenylene group,

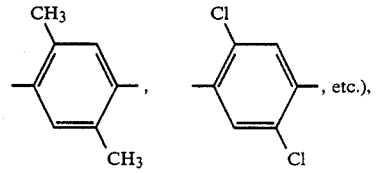

—NHCO—, —CONH—, —O—, —OCO—, etc., and aralkylene groups

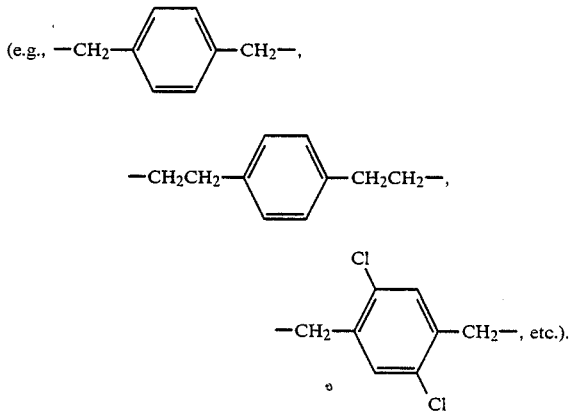

In additions, the vinyl group in the vinyl monomer includes the case that the vinyl group has a substituent in addition to the moiety shown by general formulae (VI) to (XI) described above. Preferred examples of such a substituent are a hydrogen atom, a chlorine atom, or a lower alkyl group having 1 to 4 carbon atoms.

Also, examples of the above-described non-coloring ethylenically unsaturated monomer which does not give coupling with the oxidation product of an aromatic primary amine color developing agent are acrylic acid, α-chloroacrylic acid, α-alacrylic acid (e.g., methacrylic acid, etc.), esters or amides derived from these acrylic acids (e.g., acrylamide, n-butylacrylamide, t-butylacrylamide., diacetonacrylamide, methacrylamide, methyl acrylate, ethyl acrylate, n-propyl acrylate, n-butyl acrylate, t-butyl acrylate, isooctyl acrylate, 2-ethylhexyl acrylate, n-octyl acrylate, lauryl acrylate, methyl methacrylate, ethyl methacrylate, n-butyl methacrylate, and β-hydroxy methacrylate), methylenedibisacrylamide, vinyl esters (e.g., vinyl acetate, vinyl propionate, and vinyl laurate), acrylonitrile, methacrylonitrile, aromatic vinyl compounds (e.g., styrene and the derivatives thereof, vinyltoluene, divinylbenzene, vinylacetophenone, and sulfostyrene), itaconic acid, citraconic acid, crotonic acid, vinylidene chloride, vinyl alkyl ethers (e.g., vinyl ethyl ether), maleic acid, maleic anhydride, maleic acid ester, N-vinyl-2-pyrrolidone, N-vinylpyridine, 2- or 4-vinylpyridine, etc.

These non-coloring ethylenically unsaturated monomers may be used singly or in combination.

In general formulae (VIII) and (IX) described above, at least one of $R_{12}$ and $R_{13}$ is preferably a substituted or unsubstituted alkyl group. That is, in the preferred embodiment, a substituted or unsubstituted alkyl group is bonded to the pyrazoloazole skeleton through the secondary or tertiary carbon atom. In this case, the secondary carbon atom means a carbon atom to which one hydrogen atom is bonded and also the tertiary carbon atom means a carbon atom to which no hydrogen atom is bonded. Also, it is preferred that a substituted or unsubstituted alkyl group is directly bonded to the secondary carbon atom or the tertiary carbon atom.

Specific examples of the aforesaid substituted alkyl group are a sulfonamidoalkyl group, a sulfonamidoarylalkyl group, a sulfonylalkyl group, etc., and these groups may be further substituted.

Also, in the compounds shown by general formulae (VIII) and (IX) described above, compounds shown by general formulae (XII) and (XIII) described below, respectively, are preferred.

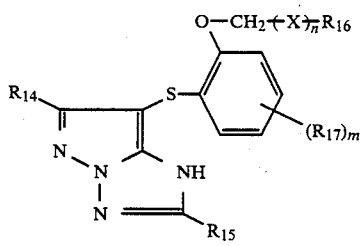

(XII)

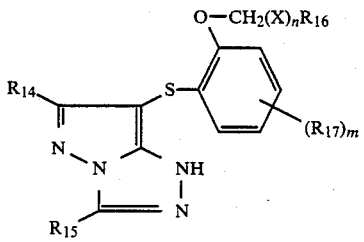

(XIII)

wherein $R_{14}$ and $R_{15}$ each represents the same group as defined for $R_{12}$ and $R_{13}$ in general formulae (VIII) and (IX) described above and at least one of said $R_{14}$ and $R_{15}$ is a group bonded to the pyrazoloazole skeleton through a nitrogen atom, an oxygen atom, or a sulfur atom. X represents $-CH_2-O-$, $-CH_2O-CH_2CH_2-$, $-CH_2SO_2-$, $-CH_2CH_2CH_2SO_2NH-$, $-CH_2CH_2CH_2SO_2NHCH_2CH_2O-$, $-CH_2CH_2CONH-$, $-CH_2-COO-$, $-CH_2CONH-$, $-CH_2CH_2CH_2CONH-$, $-CH_2CH_2SO_2-$, $-CH_2CH_2SO_2NH-$, $-CH_2CH_2NHSO_2-$, $-CH_2NHSO_2-$, $-CH_2NHCO-$, $-CH_2CH_2NHCO-$,

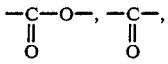

$-SO_2-$, $-SO_2NH-$,

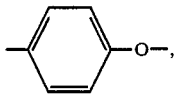

or

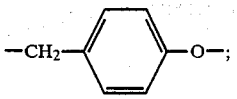

$R_{16}$ represents an alkyl group or an aryl group; $R_{17}$ represents a halogen atom, an alkoxy group, an alkyl group, an aryl group, a hydroxyl group, a cyano group, an amino group, an N-alkylamino group, an N,N-dialkylamino group, an N-anilino group, an acylamino group, a ureido group, an alkoxycarbonylamino group, an imido group, a sulfonamido group, a sulfamoylamino group, an alkoxycarbonyl group, a carbamoyl group, an acyl group, or an alkylthio group; n represents 0 or 1; and m represents an integer of from 0 to 4; when m is 2 or more, $R_{17}$s may be the same or different.

Specific examples of the substituents for $R_{16}$ and $R_{17}$ described above are those explained above for general formula (V) described above.

In particularly preferred compounds shown by general formula (XII) described above, $R_{14}$ is an alkoxy group, a ureido group, or an aryloxy group and $R_{15}$ is an alkyl group (including its substituted group).

Also, in particularly preferred compounds shown by general formula (XIII) described above, $R_{14}$ is an alkyl group or an alkoxy group and $R_{15}$ is an alkylthio group. In more preferred compounds of general formula (XIII), n is 0, $R_{16}$ is an alkyl group having 1 to 7 carbon atoms, m is 1, and $R_{17}$ is an unsubstituted alkyl group.

Examples and synthesis methods of the couplers shown by general formulae (VI) to (XI) described above are described in the following literature.

The compounds of general formula (VI) are described in Japanese Patent Application (OPI) No. 162548/84, etc., the compounds of general formula (VII) in Japanese Patent Application (OPI) No. 43659/84, the compounds of general formula (VIII) in Japanese Patent Publication No.27411/72, the compounds of general formula (IX) in Japanese Patent Application (OPI) Nos. 171956/84, 172982/85, etc., the compounds of general formula (X) are in Japanese Patent Application (OPI) No. 33552/85, etc., and the compounds of general formula (XI) are in U.S. Pat. No. 3,061,432, etc.

Furthermore, the high coloring ballast groups described in Japanese Patent Application (OPI) Nos. 42045/83, 214854/84, 177553/84, 177554/84, 177557/84, etc., can suitably be present in any compounds of general formulae (VI) to (XI) described above.

Specific examples of the pyrazoloazole series couplers shown by the aforesaid formulae for use in this invention are illustrated below but the invention is not limited to these compounds.

(M-1)

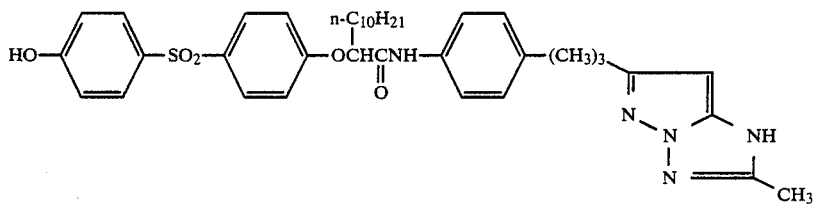

(M-2)

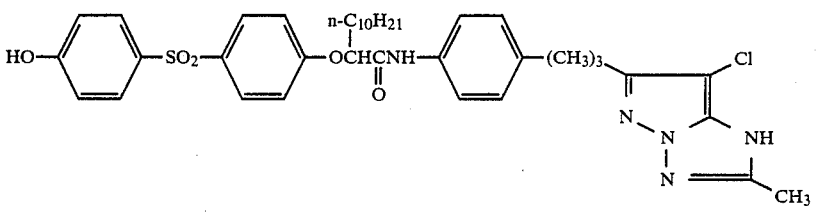

(M-3)

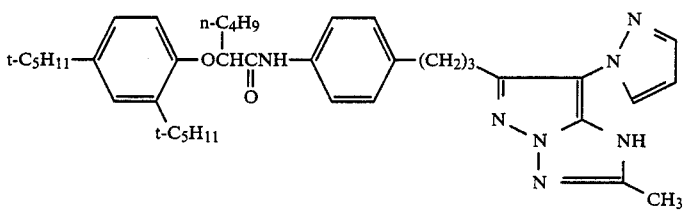

(M-4)

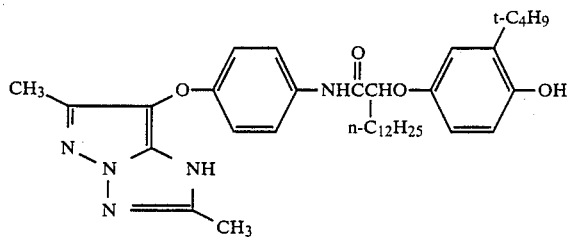

(M-5)

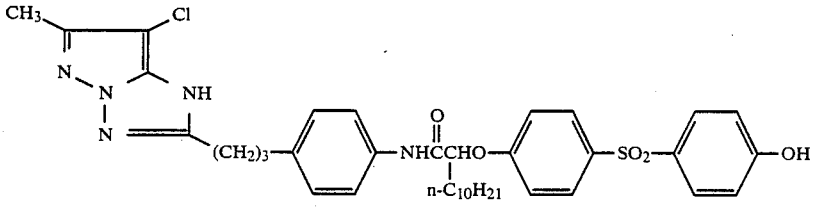

(M-6)

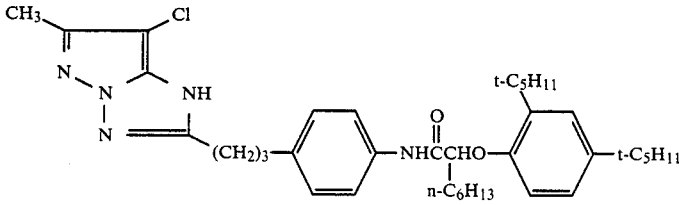

-continued
(M-7)
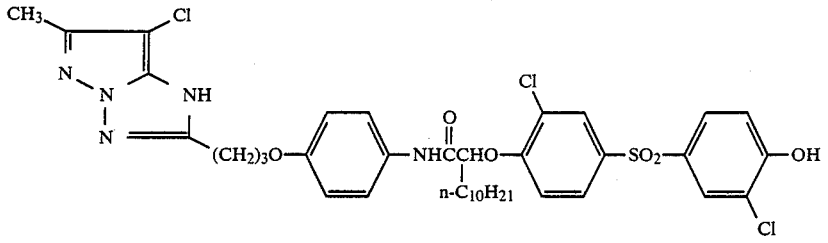
(M-8)
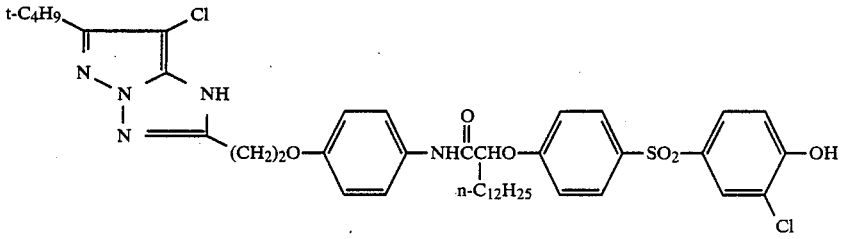
(M-9)
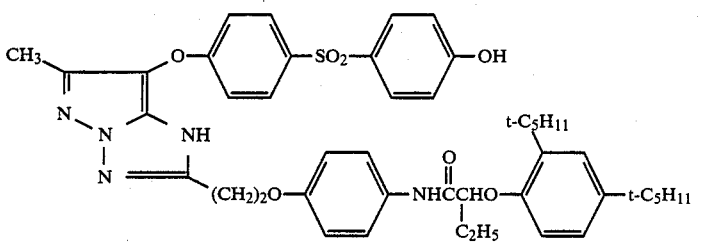
(M-10)
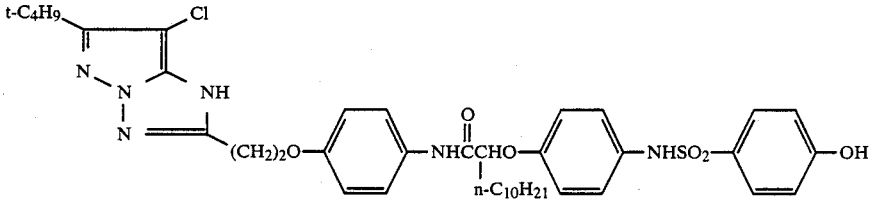
(M-11)
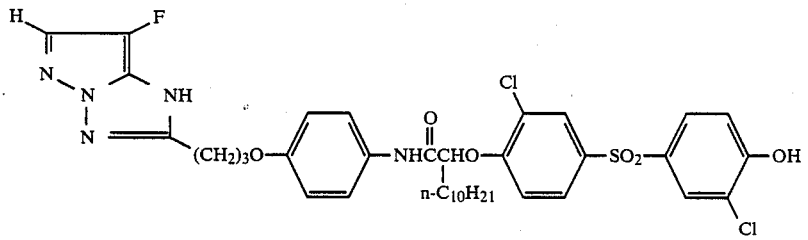
(M-12)
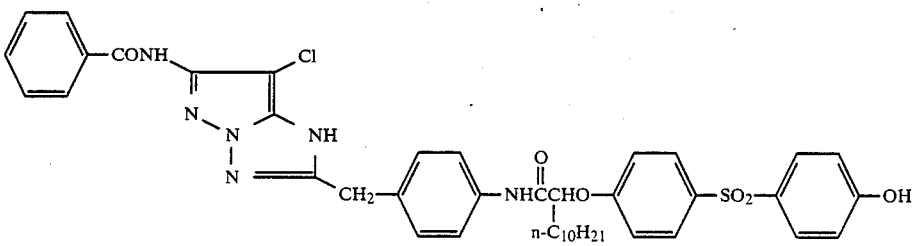

-continued
(M-13)
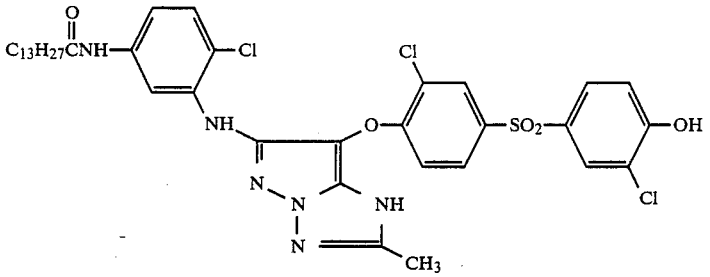
(M-14)
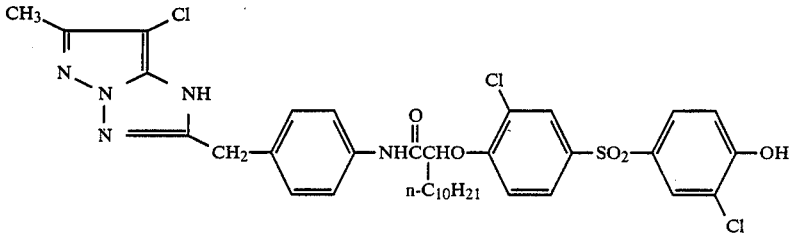
(M-15)
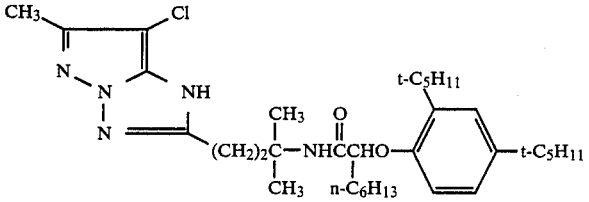
(M-16)
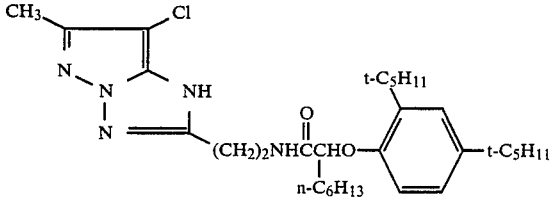
(M-17)
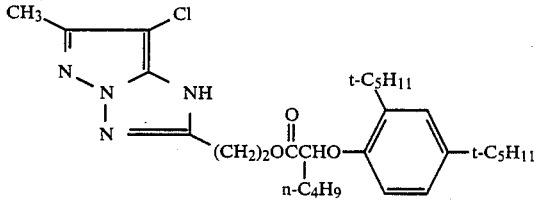
(M-18)
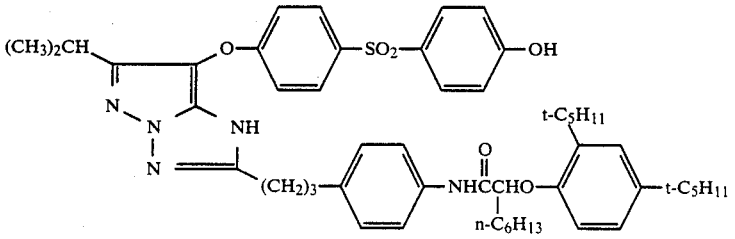

-continued
(M-19)
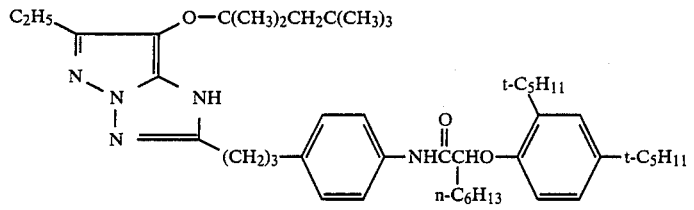
(M-20)
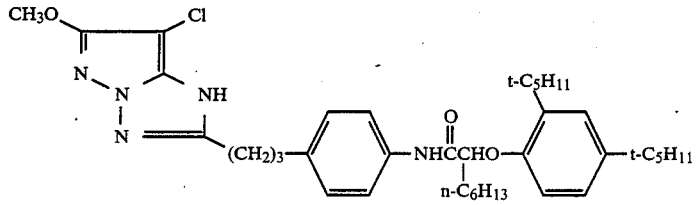
(M-21)
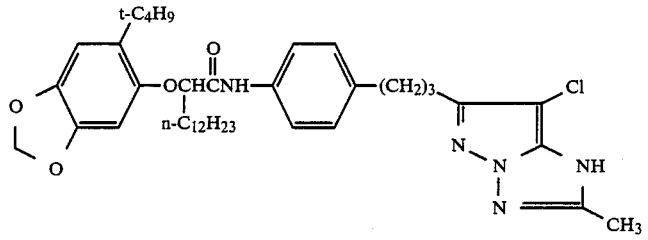
(M-22)
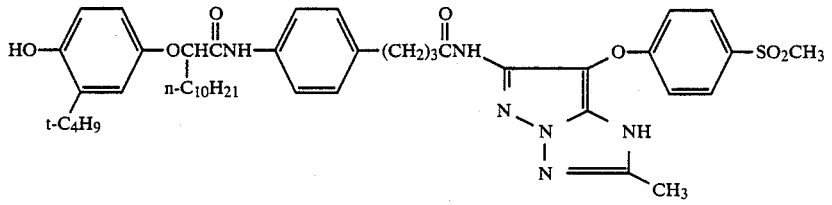
(M-23)
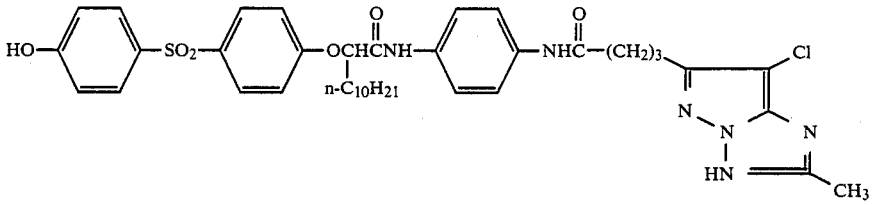
(M-24)
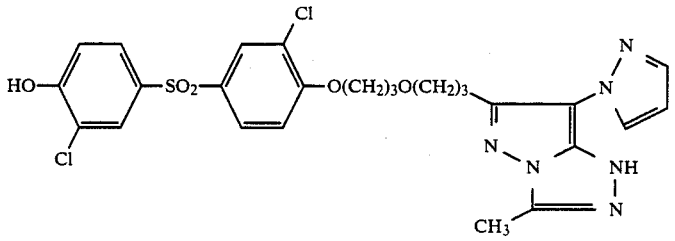

-continued
(M-25)
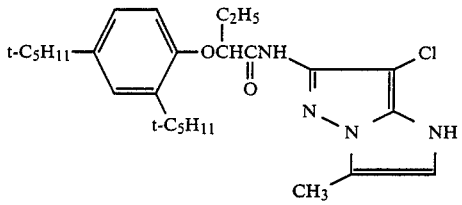
(M-26)
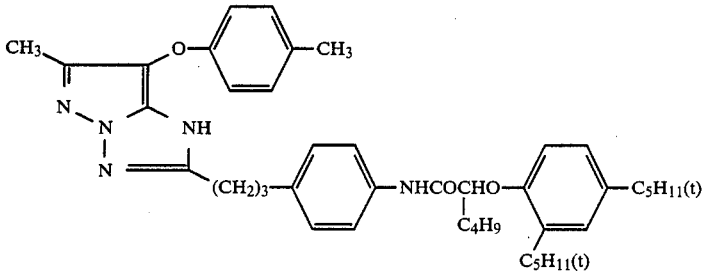
(M-27)
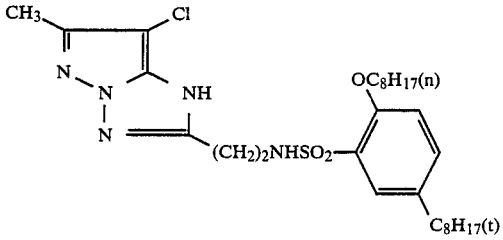
(M-28)
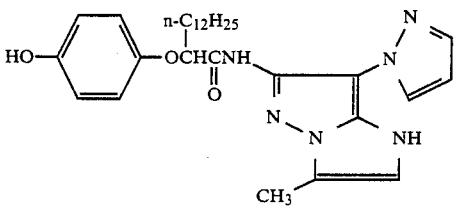
(M-29)
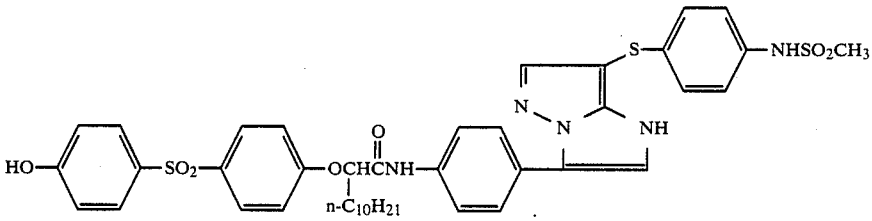
(M-30)
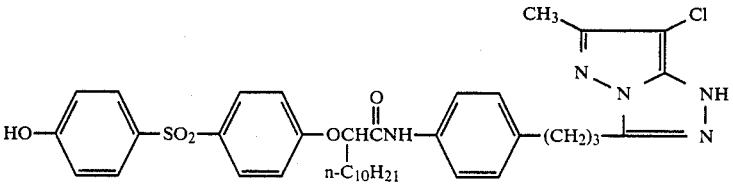

-continued
(M-31)
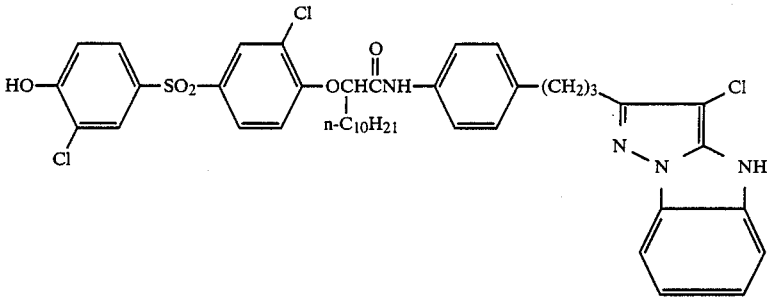
(M-32)
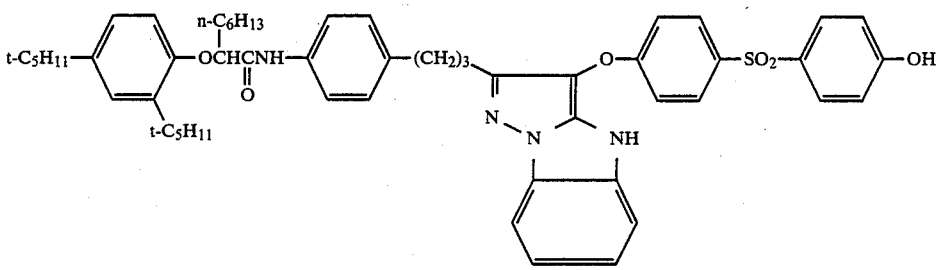
(M-33)
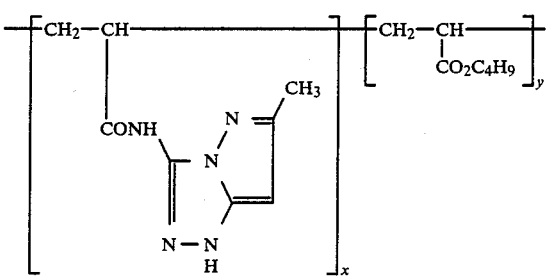
x:y = 50:50
(weight ratio, the same applies hereinbelow)
(M-34)
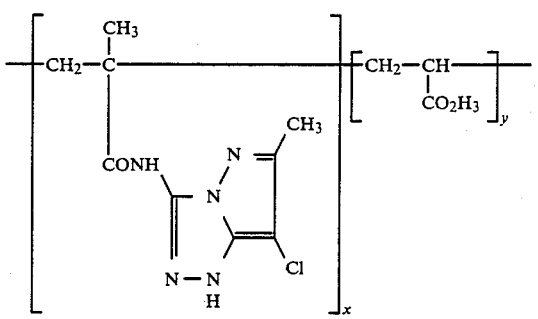
x:y = 40:60
(M-35)
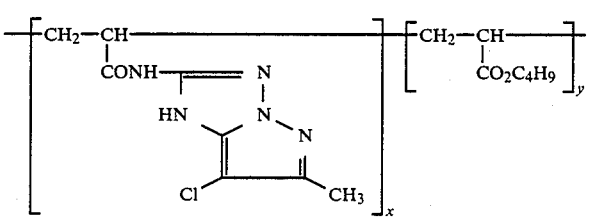
x:y = 50:50

-continued
(M-36)
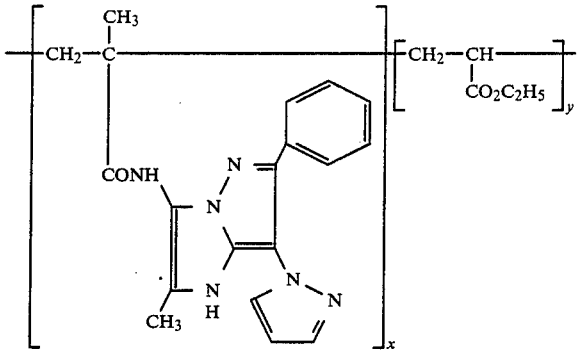
x:y = 55:45
(M-37)
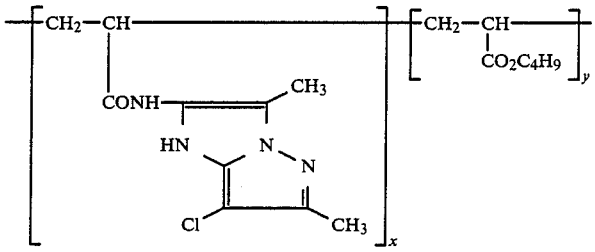
x:y = 50:50
(M-38)
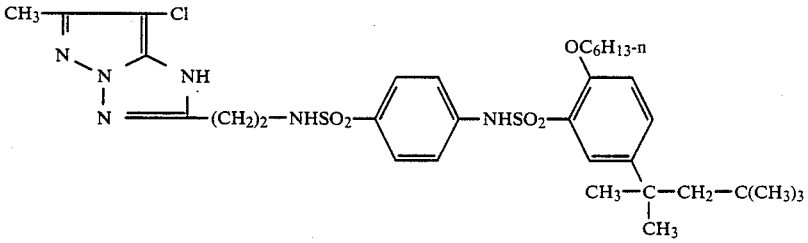
(M-39)
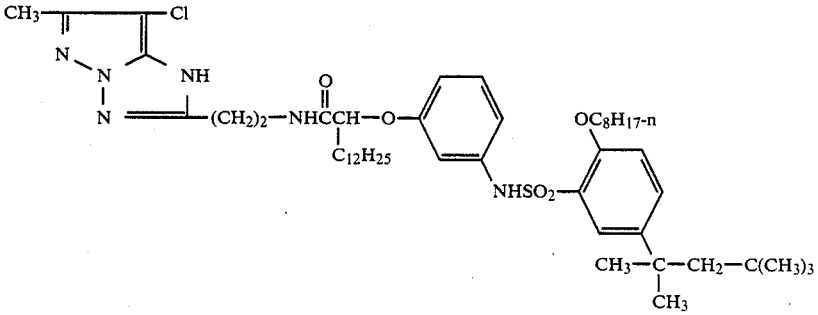

-continued
(M-40)
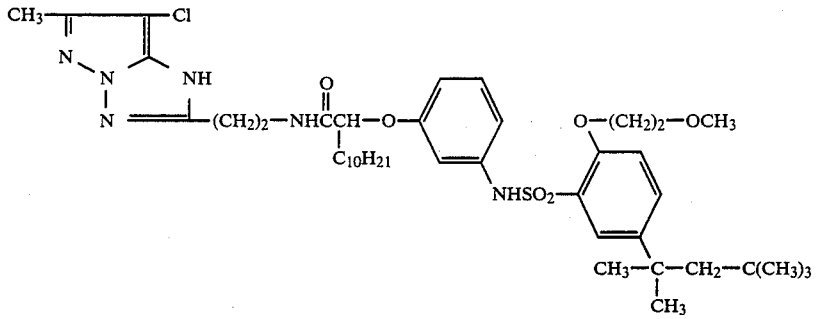
(M-41)
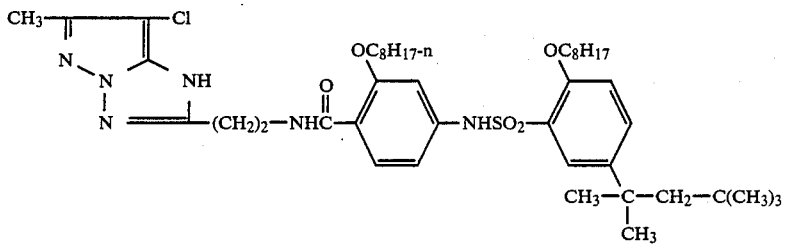
(M-42)
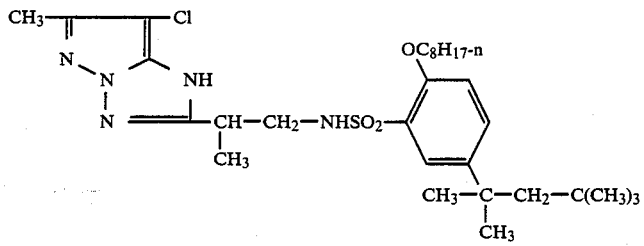
(M-43)
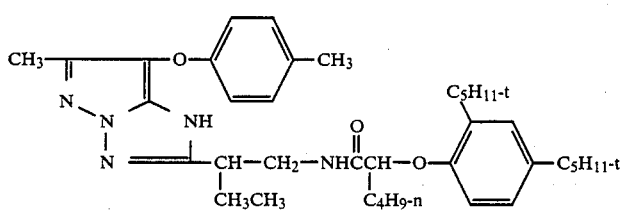
(M-44)
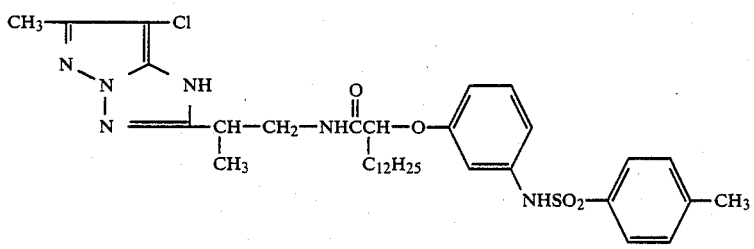
(M-45)
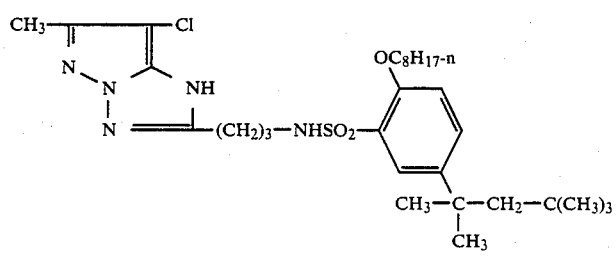

-continued
(M-46)
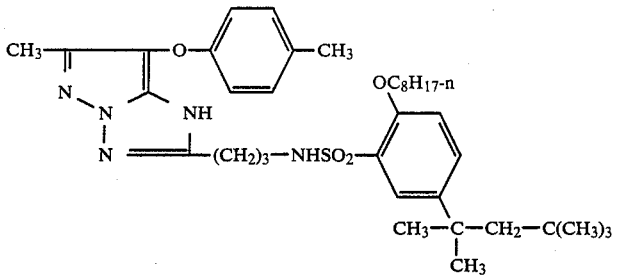
(M-47)
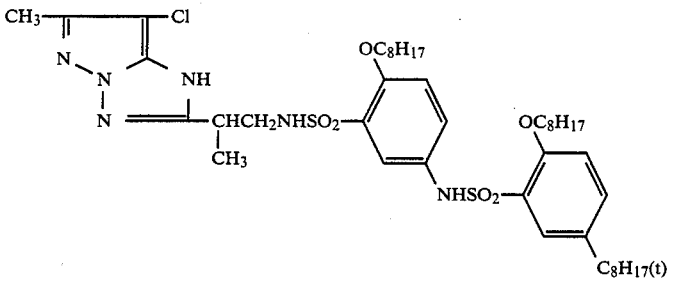
(M-48)
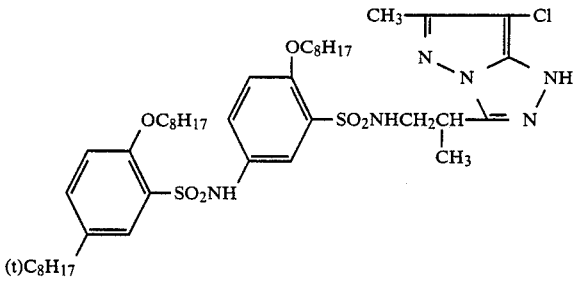
(M-49)
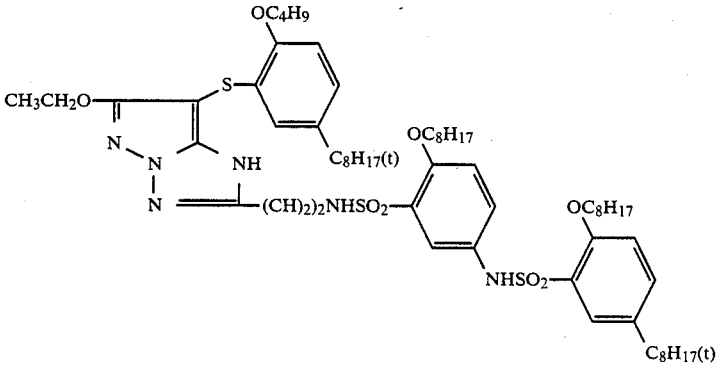

-continued
(M-50)
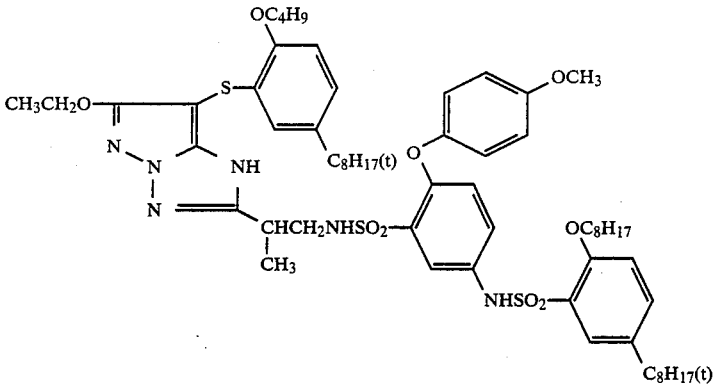
(M-51)
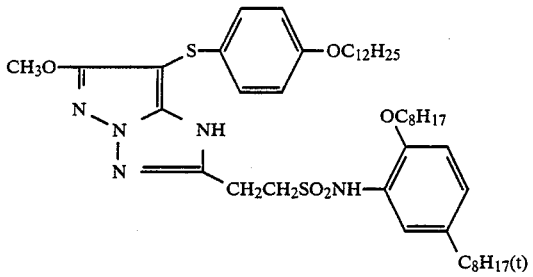
(M-52)
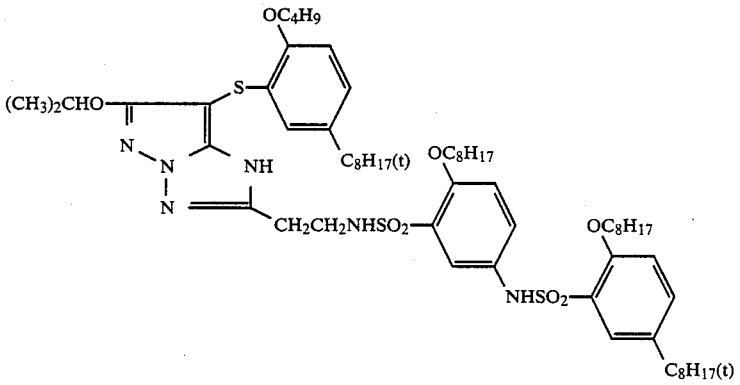
(M-53)
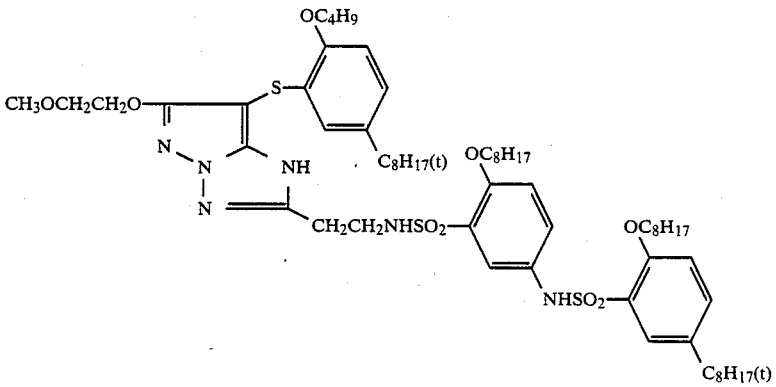

-continued
(M-54)
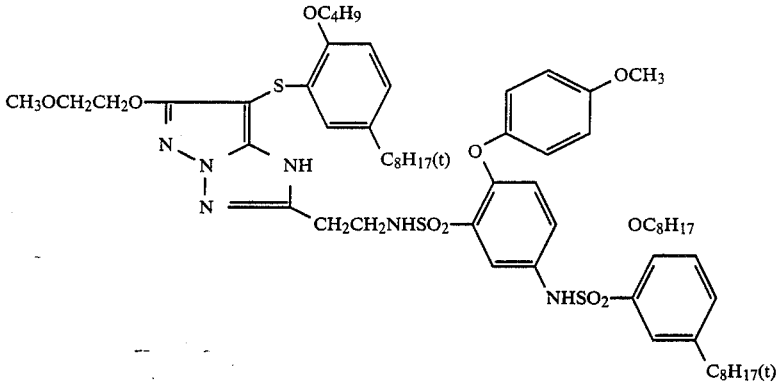
(M-55)
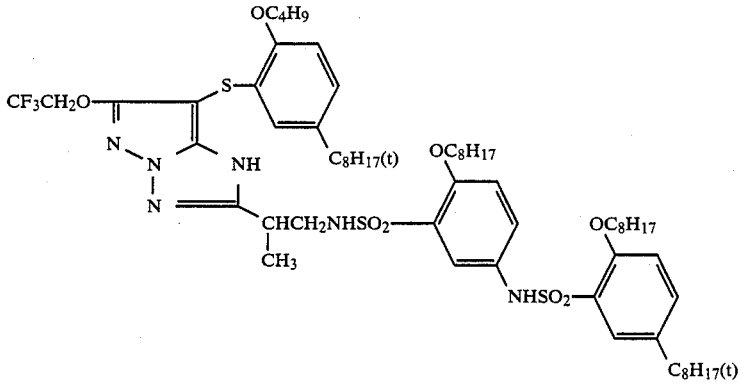
(M-56)
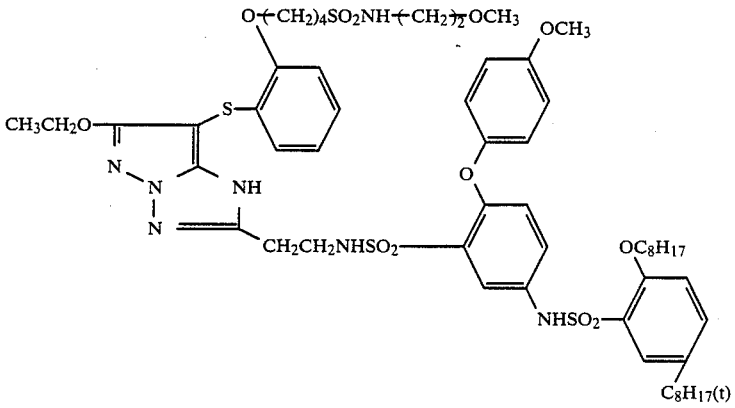
(M-57)
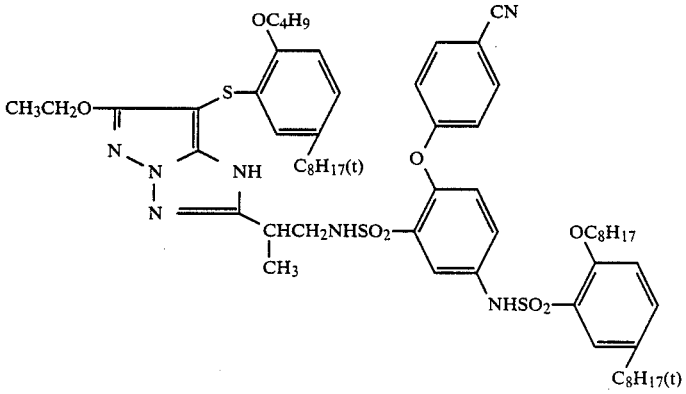

-continued
(M-58)
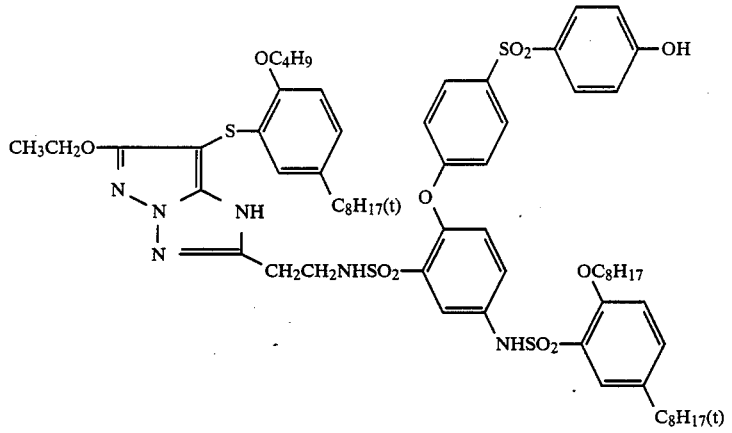
(M-59)
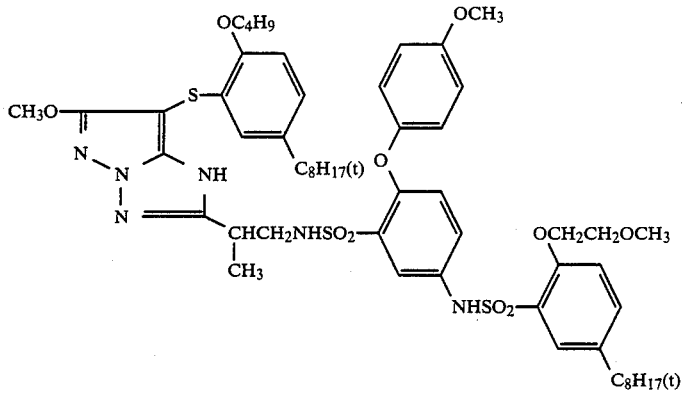
(M-60)
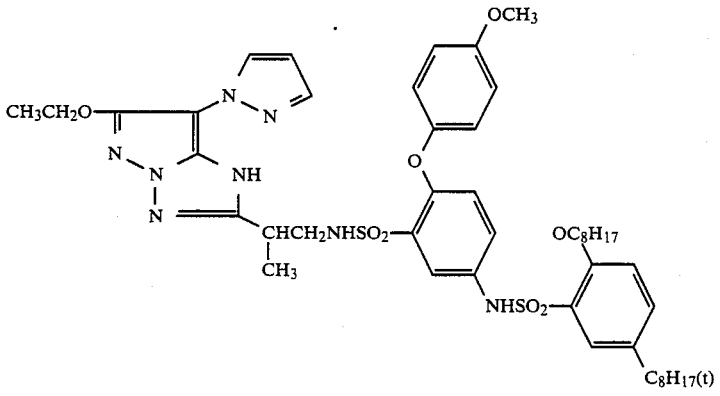
(M-61)
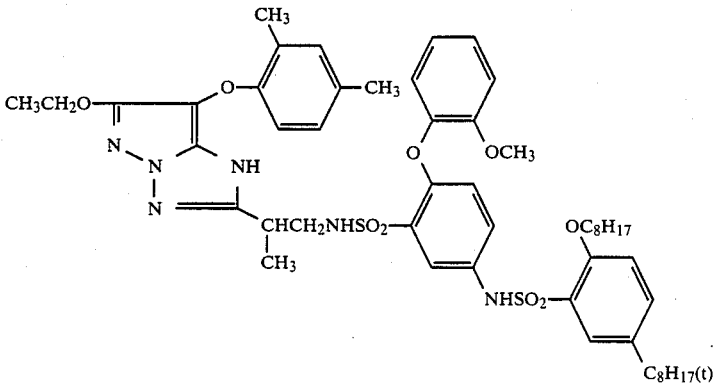

-continued
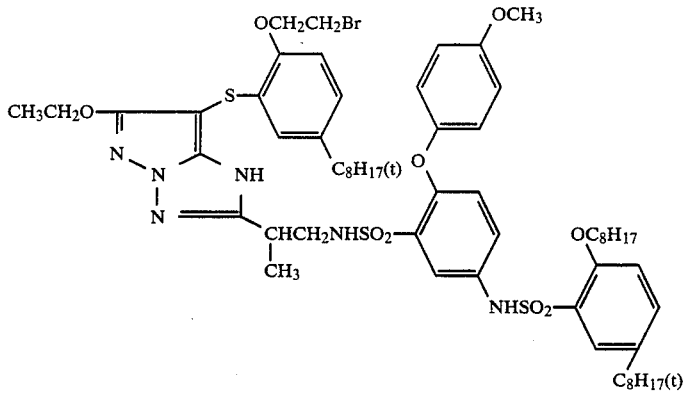
(M-62)
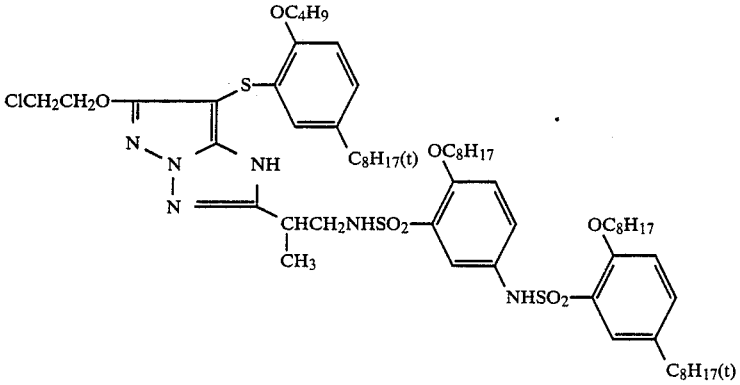
(M-63)
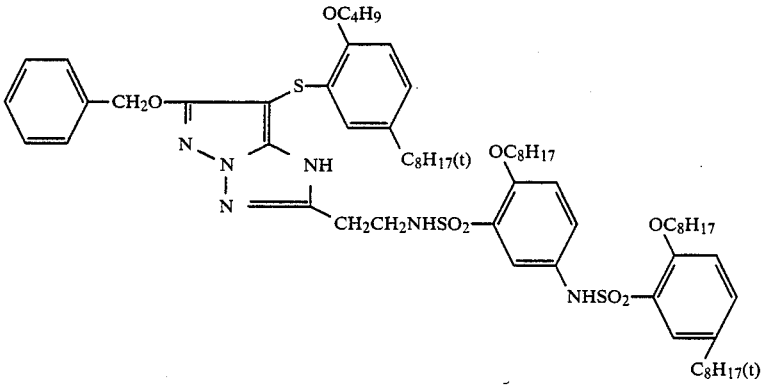
(M-64)
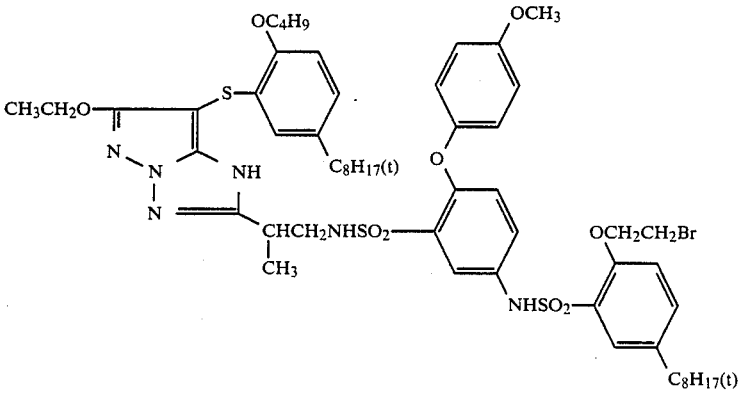
(M-65)

-continued
(M-66)
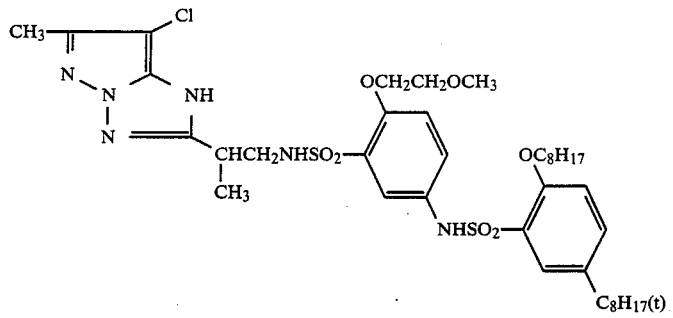
(M-67)
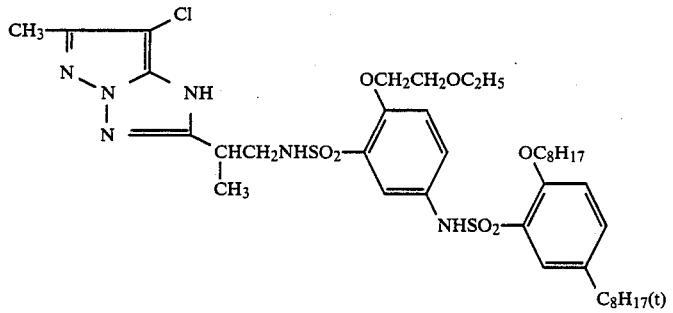
(M-68)
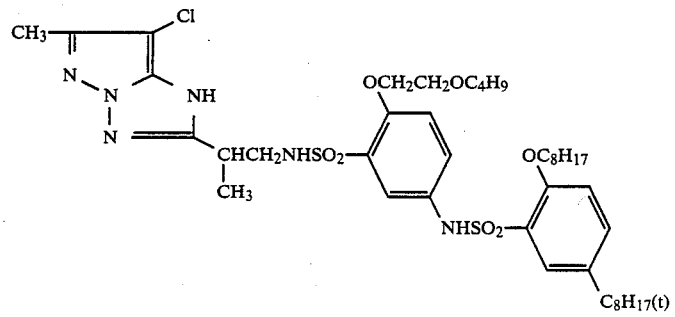
(M-69)
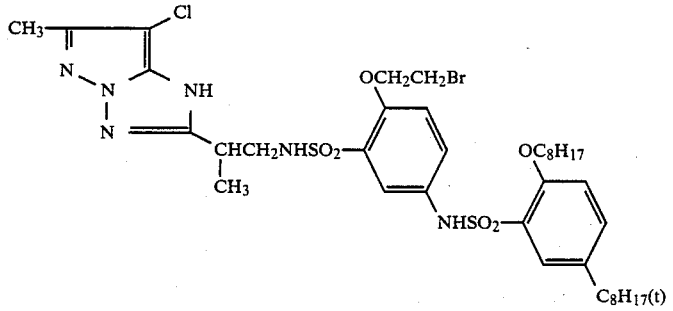
(M-70)
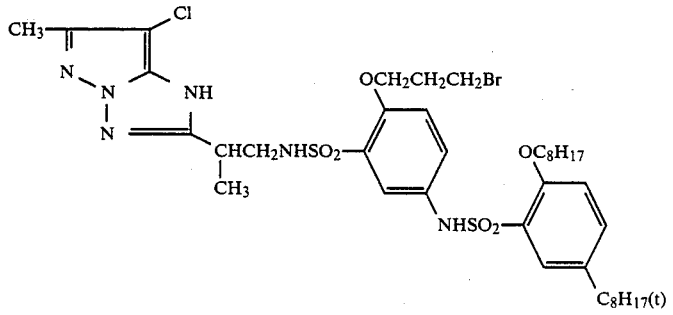

-continued
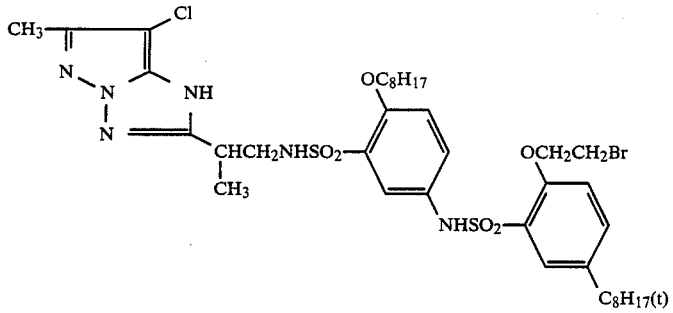
(M-71)
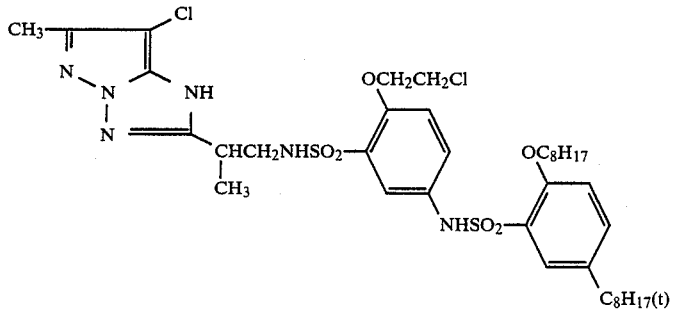
(M-72)
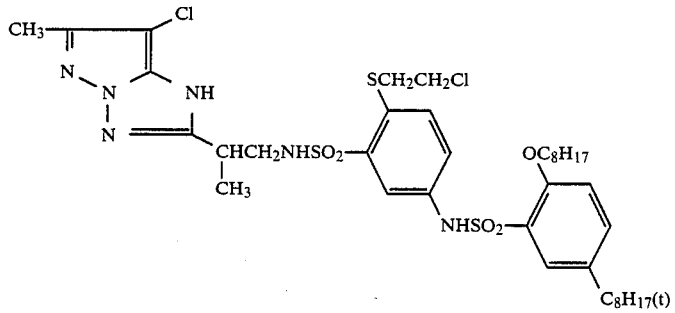
(M-73)
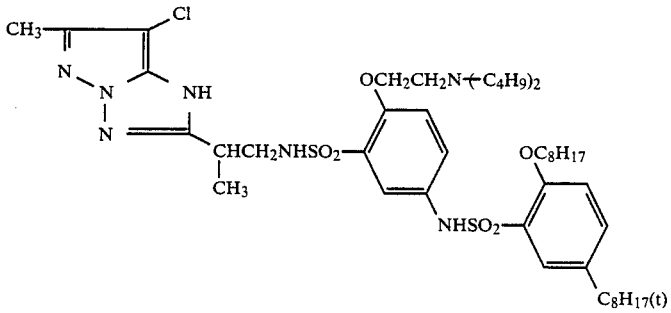
(M-74)

-continued
(M-77)
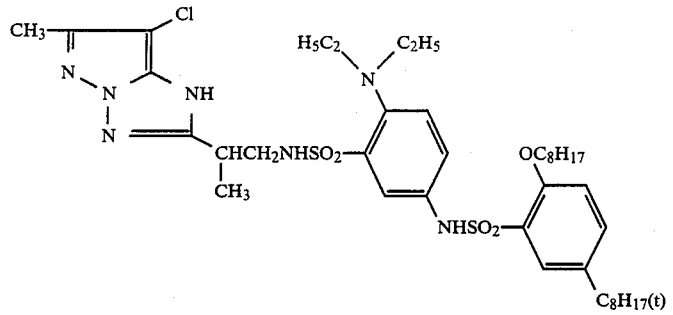
(M-78)
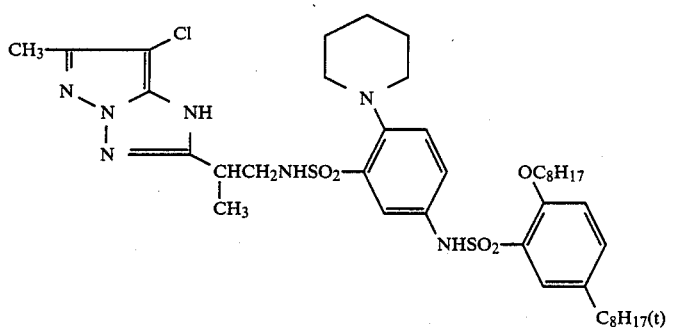
(M-79)
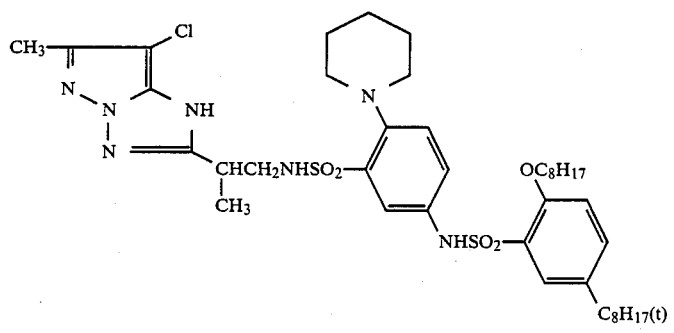
(M-80)
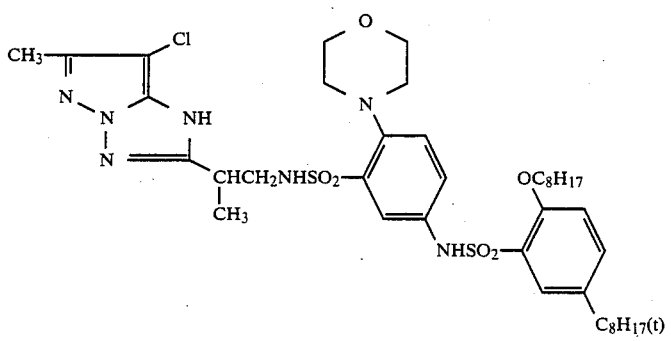

-continued
(M-81)
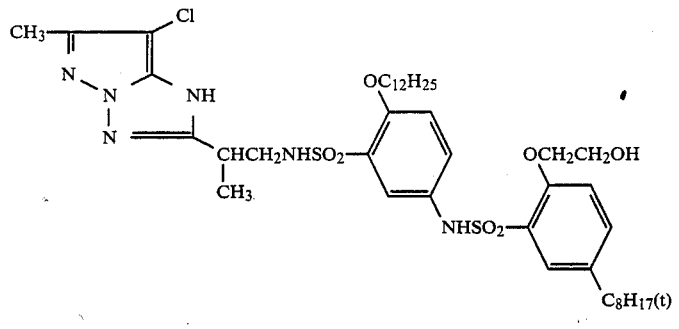
(M-82)
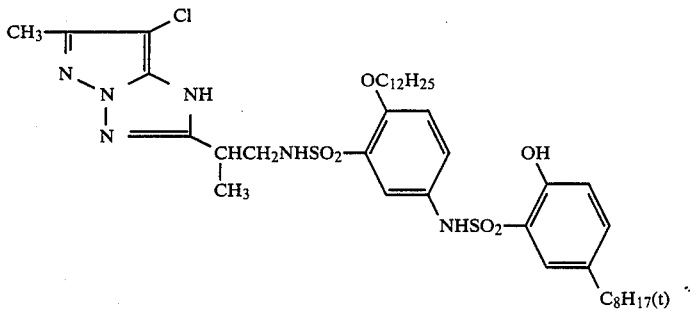
(M-83)
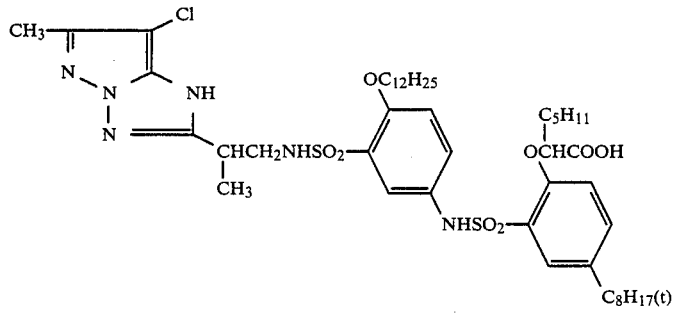
(M-84)
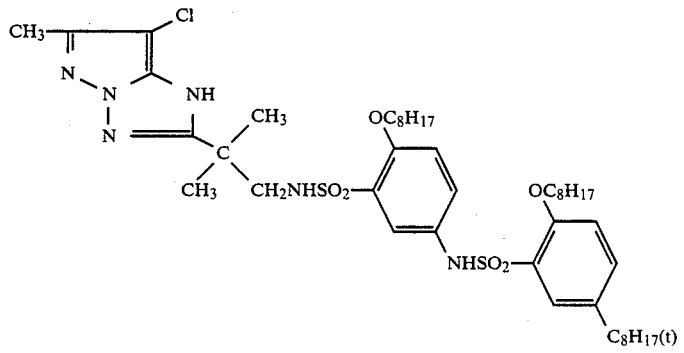

-continued
(M-85)
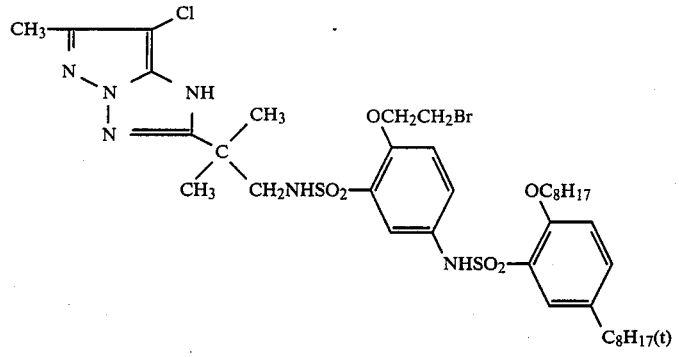
(M-86)
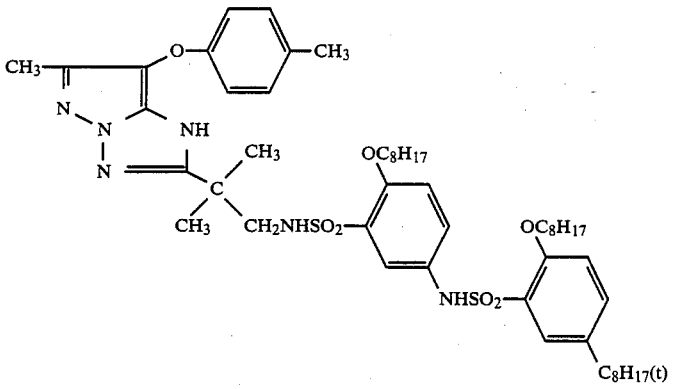
(M-87)
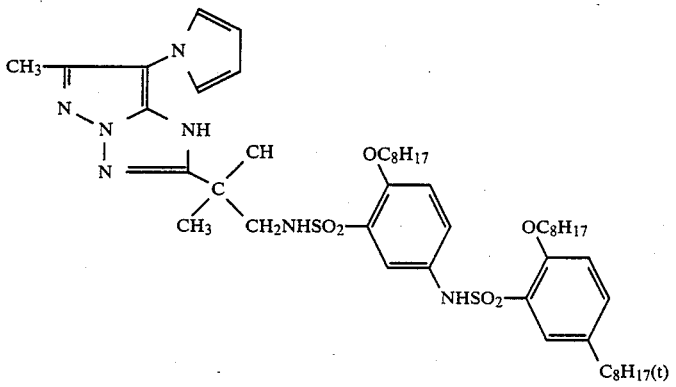
(M-88)
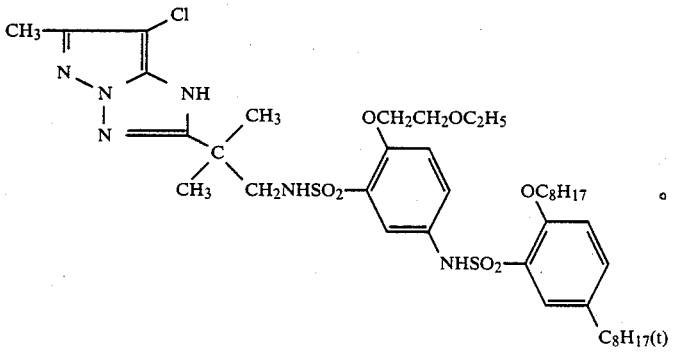

-continued
(M-89)
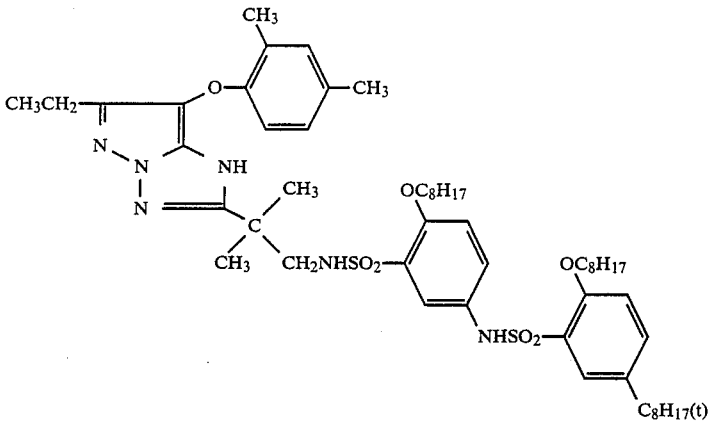
(M-90)
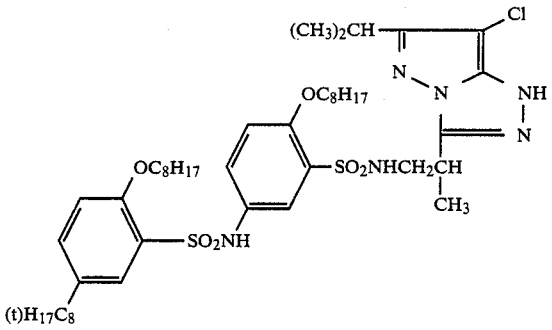
(M-91)
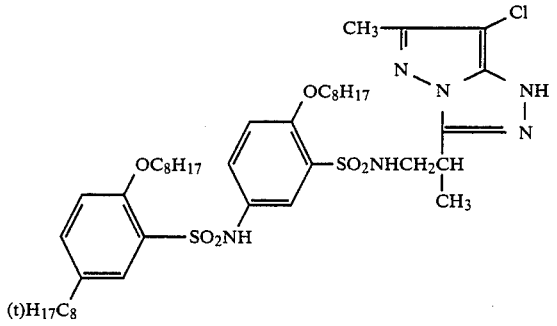
(M-92)
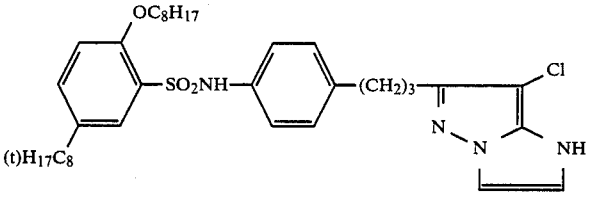
(M-93)
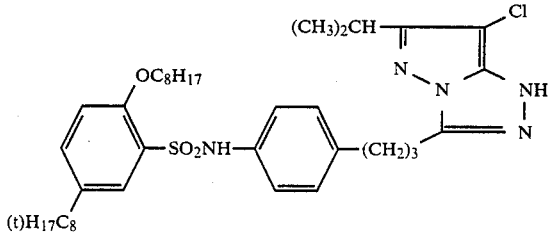

-continued
(M-94)
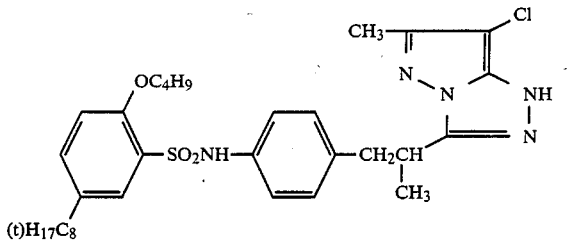
(M-95)
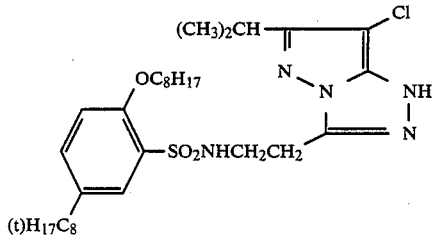
(M-96)
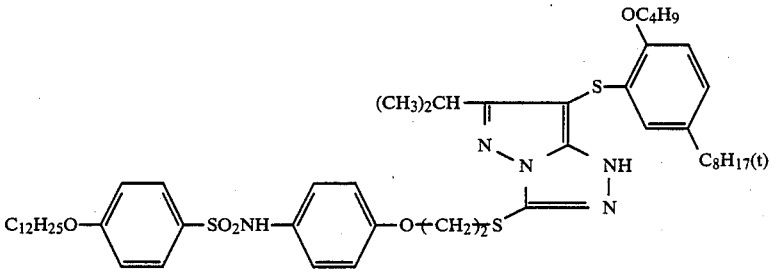
(M-97)
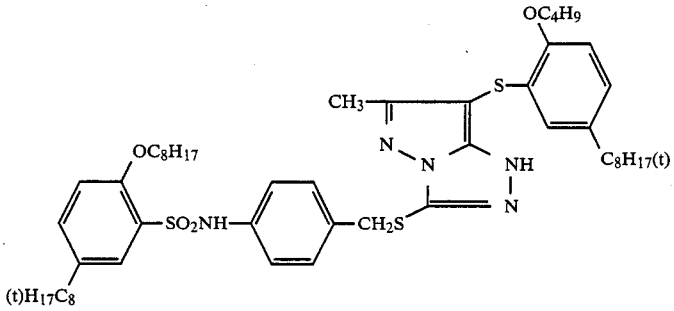
(M-98)
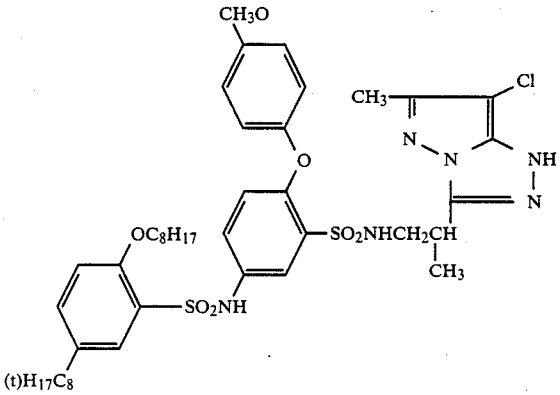

-continued
(M-99)
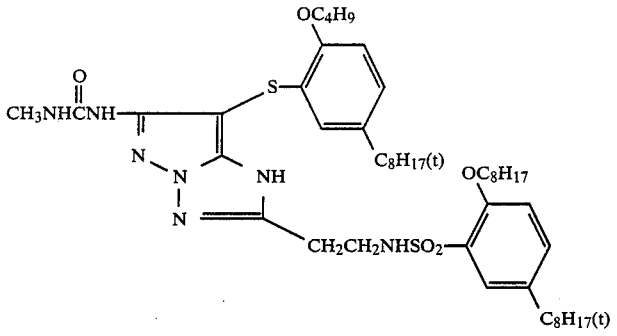
(M-100)
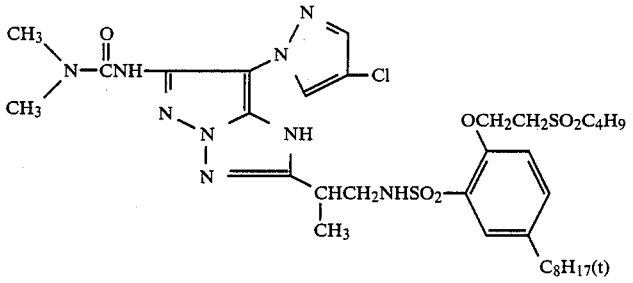
(M-101)
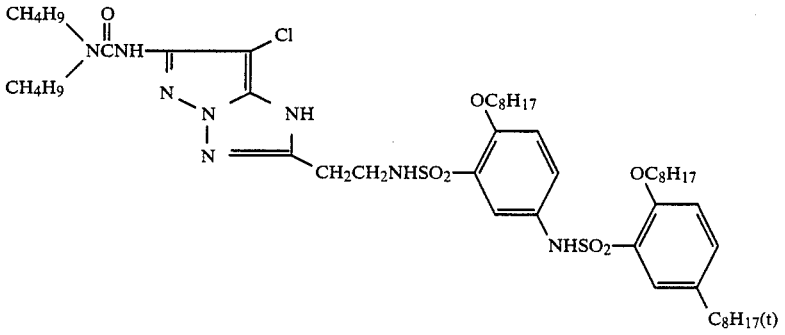
(M-102)
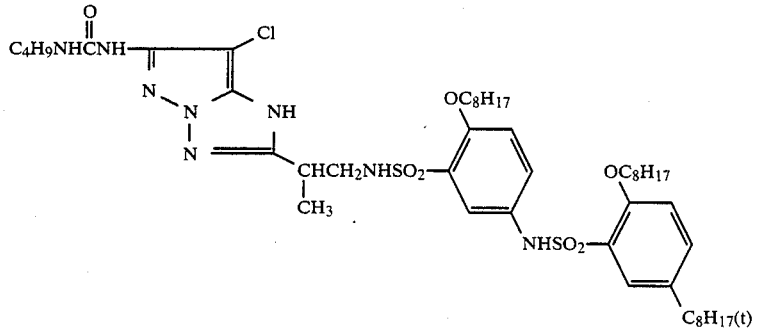

-continued (M-103)

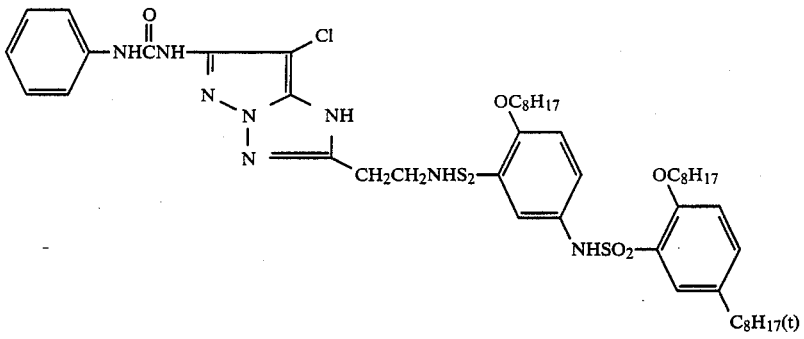

(M-104)

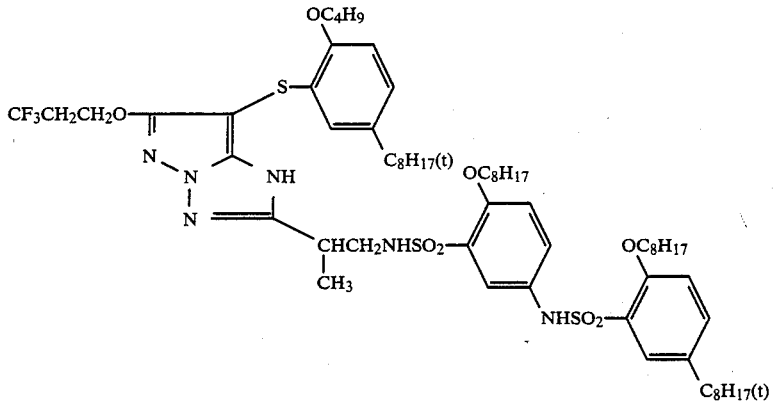

It is preferred that the color couplers contained in photographic materials for use in this invention are rendered nondiffusible by a ballast group or by being polymerized. The use of 2-equivalent color couplers, the coupling active position of which is substituted by a releasing group, is more effective in reducing the amount of silver than 4-equivalent color couplers having a hydrogen atom at its coupling active position. Couplers providing colored dyes having a proper diffusibility, non-coloring couplers, DIR couplers releasing a development inhibitor with the coupling reaction, or couplers releasing a development accelerator with the coupling reaction thereof can also be used.

Typical examples of the yellow couplers for use in this invention are oil-protect type acylacetamide series yellow couplers. Specific examples thereof are described in U.S. Pat. Nos. 2,407,210, 2,875,057, 3,265,506, etc.

In this invention, the use of 2-equivalent yellow couplers is preferred and typical examples thereof are oxygen atom-releasing type yellow couplers described in U.S. Pat. Nos. 3,408,194, 3,447,928, 3,933,501 and 4,022,620, and nitrogen atom-releasing type yellow couplers described in Japanese Patent Publication No. 10739/83, U.S. Pat. Nos. 4,401,752 and 4,326,024, *Research Disclosure,* No. 18053 (Apr., 1979), British Patent 1,425,020, West German Patent Application (OLS) Nos. 2,219,917, 2,261,361, 2,329,587 and 2,433,812. Of these couplers, α-pivaloylacetanilide series couplers are excellent in fastness, while α-benzoylacetanilide series couplers give high coloring density.

As the magenta couplers for use in this invention there may be mentioned oil-protect type indazolone series or cyanoacetyl series magenta couplers, preferably 5-pyrazolone series couplers and pyrazoloazole series couplers such as pyrazolotriazole series couplers. The 5-pyrazolone series couplers having an arylamino group or an acylamino group at the 3-position thereof are preferred from the viewpoint of the hue of the colored dyes and the coloring density, and typical examples of the couplers are described in U.S. Pat. Nos. 2,311,082, 2,343,703, 2,600,788, 2,908,573, 3,062,653, 3,152,896, 3,936,015, etc. Preferred releasing groups for the 2-equivalent 5-pyrazolone series magenta couplers include nitrogen atom-releasing groups described in U.S. Pat. No. 4,310,619 and arylthio groups described in U.S. Pat. No. 4,351,897. Also, 5-pyrazolone series couplers having a ballast group described in European Patent 73,636 give high coloring density.

As described hereinbefore, pyrazoloazole series couplers are particularly preferred in this invention and practically they are selected from the compounds shown by general formula (V) described above.

Cyan couplers for use in this invention include oil-protect type naphtholic and phenolic couplers. Typical examples of the cyan couplers are naphtholic couplers described in U.S. Pat. No. 2,474,293, and preferably oxygen atom-releasing type 2-equivalent naphtholic couplers described in U.S. Pat. Nos. 4,052,212, 4,146,396, 4,228,233 and 4,296,200. Also, specific examples of the phenolic couplers are described in U.S. Pat. Nos. 2,369,929, 2,801,171, 2,772,162, 2,895,826, etc. Cyan couplers having high fastness to moisture and heat are preferably used in this invention, and typical examples thereof are the phenolic cyan couplers having an alkyl group of 2 or more carbon atoms at the meta-position of the phenol nucleus described in U.S. Pat. No. 3,772,002, 2,5-diacylamino-substituted phenolic couplers described in U.S. Pat. Nos. 2,772,162, 3,758,308, 4,126,396, 4,334,011 and 4,327,173, West German Patent Application (OLS) No. 3,329,729, Japanese Patent Application (OPI) No.166956/84, etc., and phenolic couplers having a phenulureido group at the 2-position and an acylamino group at the 5-position thereof described in U.S. Pat. Nos. 3,446,622, 4,333,999, 4,451,559, 4,427,767, etc.

In this invention, the graininess of the color images formed can be improved by simultaneously using a coupler giving colored dye having a proper diffusibility and the aforesaid coupler(s). For such couplers giving diffusible dyes, specific examples of the magenta couplers are described in U.S. Pat. No. 4,366,237 and British Patent 2,125,570 and specific examples of the yellow, magenta, and cyan couplers are described in European Patent 96,570 and West German Patent Application (OLS) No. 3,234,533.

The dye-forming couplers and the specific couplers described above may form a dimer or higher polymer. Typical examples of the polymerized dye-forming couplers are described in U.S. Pat. Nos. 3,451,820 and 4,080,211. Also, specific examples of the polymerized magenta couplers are described in British Patent 2,102,173 and U.S. Pat. No. 4,367,282.

The couplers for use i this invention can be used in one light-sensitive emulsion layer as a mixture of two or more couplers for meeting the properties required for the color photographic material or the same kind of coupler may be incorporated into two or more photographic emulsion layers.

The couplers for use in this invention can be introduced into silver halide emulsions by an oil drop-in-water dispersion method. That is, in the oil drop-in-water dispersion method, the coupler is dissolved in a high boiling organic solvent having a boiling point of at least 175° C. or a low boiling solvent, so-called auxiliary solvent, or a mixture of both types of solvents, and then finely dispersed in water or an aqueous meidum such as an aqueous gelatin solution in the presence of a surface active agent. Examples of the high boiling organic solvent are described in U.S. Pat. No. 2,322,027, etc. In this case, the coupler may be dispersed with phase inversion and also, if necessary, the auxiliary solvent may be removed by distillation, noodle washing, or ultrafiltration before coating the dispersion.

Specific examples of the high boiling organic solvent are phthalic acid esters (e.g., dibutyl phthalate, dicyclohexyl phthalate, di-2-ethylhexyl phthalate, decyl phthalate, etc.), phosphoric acid esters or phosphonic acid esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, etc.), benzoic acid esters (e.g., 2-ethylhexyl benzoate, dodecyl benzoate, 2-ethylhexyl-p-hydroxy benzoate, etc.), amides (e.g., diethyldodecanamide, N-tetradecylpyrrolidone, etc.), alcohols or phenols (e.g., isostearyl alcohol, 2,4-di-tert-amylphenol, etc.), aliphatic carboxylic acid esters (e.g., dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc.

As the auxiliary solvent, organic solvents having a boiling point of at least about 30° C., preferably from about 50° C. to about 160° C. can be used and specific examples thereof are ethyl acetate, butyl acetate, ethyl propionate, methyl ethyl ketone, cyclohexanone, 2-ethoxyethyl acetate, dimethylformamide, etc.

The process and effect of the latex dispersion method and specific examples of the latex for impregnation are described in U.S. Pat. No. 4,199,363, West German Patent Application (OLS) Nos. 2,541,274, 2,541,230, etc.

A standard amount of the color coupler is in the range of from 0.001 mol to 1 mol per mol of the light-sensitive silver halide, with from 0.01 mol to 0.5 mol of a yellow coupler, from 0.003 to 0.3 mol of a magenta coupler, and from 0.002 mol to 0.3 mol of a cyan coupler being preferred.

The color photographic materials for use in this invention may further contain hydroquinone derivatives, aminophenol derivatives, amines, gallic acid derivatives, catechol derivatives, ascorbic acid derivatives, colorless compound-forming couplers, sulfonamidophenol derivatives, etc., as color fogging preventing agents or color mixing preventing agents.

Also, the color photographic materials for use in this invention can further contain discoloration preventing agents. Typical examples of organic discoloration preventing agents are hydroquinones, 6-hydroxychromans, 5-hydroxycoumarans, spirochromans, p-alkoxyphenols, hindered phenols including bisphenols, gallic acid derivatives, methylenedioxybenzenes, aminophenols, hindered amines and the ether or ester derivatives of the aforesaid compounds obtained by silylating or alkylating the phenolic hydroxyl group of these compounds. Also, metal complexes such as (bissalicylaldoxymate) nickel complex and (bis-N,N-dialkyldithiocarbamate) nickel complex can also be used as the discoloration preventing agent.

For preventing the deterioration of yellow dye images by heat, moisture, and light, the compound having both moieties of hindered amine and hindered phenol in one molecule as described in U.S. Pat. No. 4,268,593 gives good results. Also, for preventing the deterioration of magenta dye images, particularly by light, spiroindans described in Japanese Patent Application (OPI) No. 159644/81 and chromans substituted by hydroquinone diether or hydroquinone monoether described in Japanese Patent Application (OPI) No. 89835/80 give preferred results.

For improving the storage stability, in particular, the light fastness of cyan images, it is preferred to use a benzotriazole series ultraviolet absorber with the cyan coupler(s). The ultraviolet absorber may be co-emulsified with the cyan coupler(s).

The amount used of the ultraviolet absorber is desirably sufficient for imparting light stability to cyan dye images, but since if the amount is too much, the unexposed portions (background portions) of the color photographic material are sometimes yellowed, the amount thereof is usually selected in the range of from $1\times10^{-4}$ mol/m$^2$ to $2\times10^{-3}$ mol/m$^2$, particularly from $5\times10^{-4}$ mol/m$^2$ to 1.5 mol/m$^2$.

In the layer structure of an ordinary color photographic paper, the ultraviolet absorber(s) are incorporated in one or both layers adjacent to a red-sensitive silver halide emulsion layer containing cyan coupler. When the ultraviolet absorber(s) are incorporated in the interlayer between a green-sensitive emulsion layer and a red-sensitive emulsion layer, the ultraviolet absorber(s) may be emulsified together with a color mixing preventing agent. When ultraviolet absorbers are incorporated in a protective layer, another protective layer may be formed on the protective layer as the outermost layer. The outermost protective layer may contain a matting agent having a proper particle size.

The color photographic material for use in this invention may further contain ultraviolet absorber in the hydrophilic colloid layer.

The color photographic materials for use in this invention may further contain water-soluble dyes in the hydrophilic colloid layers as filter dyes or for the purpose of irradiation prevention or halation prevention.

The color photographic materials for use in this invention may further contain whitening agents such as stilbene series, triazine series, oxazole series, or coumarin series whitening agents in the photographic emulsion layers or other hydrophilic colloid layers. The whitening agent may be water-soluble or a water-insoluble whitening agent may be used in the form of a dispersion.

The process of this invention can be applied to a multilayer multicolor photographic material having on a support at least two photographic emulsion layers each having different spectral sensitivity as described above. A multilayer natural color photographic material usually has at least one red-sensitive emulsion layer, at least one green-sensitive emulsion layer, and at least one blue-sensitive emulsion layer on a support. The disposition order of the emulsion layers can be optionally selected according to the purposes. Also, each of the aforesaid emulsion layers may be composed of two or more emulsion layers each having different light sensitivity or a light-insensitive layer may exist between two or more emulsion layers each having the same sensitivity.

The color photographic material for use in this invention preferably has auxiliary layers such as a protective layer, interlayers, a filter layer, an antihalation layer, a back layer, etc., in addition to the silver halide emulsion layers.

As a binder or protective colloid which can be used in the emulsion layers and auxiliary layers of the color photographic material for use in this invention, gelatin is advantageously used but other hydrophilic colloids may also be used.

Examples of the protective colloid are proteins such as gelatin derivatives, graft polymers of gelatin and other polymers, albumin, casein, etc.; cellulose derivatives such as hydroxyethyl cellulose, carboxymethyl cellulose, cellulose sulfuric acid ester, etc.; saccharose derivatives, such as sodium alginate, starch derivatives, etc.; and synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, limed gelatin as well as acidtreated gelatin and enzyme-treated gelatin as described in *Bull. Soc. Sci. Phot. Japan,* No. 16, p. 30 (1966) can be used. Furthermore, hydrolyzed product or enzyme-decomposed product of gelatin can be used.

The color photographic materials for use in this invention may further contain various stabilizers, stain preventing agents, developing agents or the precursors therefor, development accelerators or the precursors therefor, lubricants, mordants, matting agents, antistatic agents, plasticizers, or any other photographically useful additives in addition to the above-described additives. Typical examples of such additives are described in *Research Disclosure,* No. 17643 (December, 1978) and ibid., No. 18716 (November, 1979).

The "reflective support" for the color photographic material which is used in this invention is a support having high reflectivity for clearly viewing color images fomred in silver halide emulsion layer(s) and includes a support coated with a hydrophobic resin with a light reflective material dispersed therein such as titanium oxide, zinc oxide, calcium carbonate, calcium sulfate, etc., and a support composed of a hydrophobic resin containing the light reflective material as described above. Examples of such a support are baryta papers, polyethylene-coated papers, polypropylene series synthetic papers, and transparent support having a reflective layer or containing a reflective material. Examples of the transparent support are glass plates, polyester films (e.g., polyethylene terephthalate films, cellulose triacetate films, cellulose nitrate films, etc.), polyamide films, polycarbonate films, polystyrene films, etc.

Then, the processing process (image-forming process) of this invention will be described.

The processing time for the color processing steps in this invention is as short as not longer than 2 minutes and 30 seconds, and preferably from 30 seconds to 2 minutes. The processing time in this invention is the time required for a color photographic material from the contact with a color developer to the contact with a subsequent bath and includes the traveling time between the baths.

The color developer which is used for the processing process of this invention is an aqueous alkaline solution containing an aromatic primary amine color developing agent as the main component. As the color developing agent, p-phenylenediamine series compounds are preferably used and typical examples thereof are 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, sulfates, hydrochlorides, phosphates, or p-toluenesulfonates thereof, tetraphenylborates, p-(t-octyl)benzenesulfonates, etc.

Examples of aminophenol derivatives which can also be used as the color developing agent include o-aminophenol, p-aminophenol, 4-amino-2-methylphenol, 2-amino-3-methylphenol, 2-oxy-3-amino-1,4-dimethylbenzene, etc.

Other color developing agents described in L. F. A. Mason, *Photographic Processing Chemistry,* pages 226–229, Focal Press, U.S. Pat. Nos. 2,193,015 and 2,592,364, Japanese Patent Application (OPI) No. 64933/73, etc., may also be used in this invention. If necessary, two or more kinds of these color developing agents can also be used in combination.

The processing temperature in the color developer in this invention is preferably from 30° C. to 50° C., and more preferably from 33° C. to 42° C.

As a development accelerators, various kinds of compounds substantially excluding benzyl alcohol may be used for the color developer in this invention. Examples of thee compounds are pyridinium compounds described in U.S. Pat. No. 2,648,604, Japanese Patent Publication No. 9503/69, and U.S. Pat. No. 3,171,247 and other cationic compounds; cationic dyes such as phenofuranin; neutral salts such as thallium nitrate and potassium nitrate; nonionic compounds such as polyethylene glycol, derivatives thereof, and polythioether described in Japanese Patent Publication No. 9304/69, U.S. Pat. Nos. 2,533,990, 2,531,832, 2,950,970 and 2,577,127; thioether series compounds described in U.S.

Patent 3,201,242; and other compounds described in Japanese Patent Application (OPI) Nos. 156934/83 and 220344/85.

Also, in a short time processing process as in this invention, not only a means for accelerating development but also a technique for preventing the formation of development fog are important. As the antifoggant in this invention, alkali metal halide such as potassium bromide, sodium bromide, potassium iodide, etc., and organic antifoggants are preferred. Examples of organic antifoggants which can be used in this invention include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine, etc., mercapto-substituted heterocyclic compounds such as 1-phenyl-5-mercaptotetrazole, 2-mercaptobenzimidazole, 2-mercaptobenzothiazole, etc., and mercapto-substituted aromatic compounds such as thiosalicylic acid, etc. The halides are particularly preferred. These antifoggants may be dissolved off from color photographic materials during processing and may be accumulated in a color developer.

It is well known that the concentration of $Br^-$ ion contained in a color developer greatly changes the development speed, and in the art are known a standard processing type of performing color development for 3 minutes and 30 seconds at 33° C. with a KBr concentration of about 0.5 g/liter and a low replenisher type of performing color development for 30 seconds at 38° C. with a KBr concentration of about 1 g/liter. By increasing KBr concentration from 0.5 g/liter to 1 g/liter for low replenisher processing, it is required to raise the development temperature by 5° C.

In the process of this invention, the amount of $Br^-$ ion released from color photographic materials is low and, hence, it is possible to increase the development speed as a color developer of lower KBr concentration.

Alo, it is possible to form a low replenisher color developer by utilizing the lower $Br^-$ ion-releasing property and also an intermediate between the two cases can be selected.

A preferred $Br^-$ ion concentration in a color developer for use in this invention is from $1\times10^{-2}$ mol/liter to $4.2\times10^{-4}$ mol/liter. More preferably, the $Br^-$ ion concentration is from $5\times10^{-3}$ mol/liter to $6.7\times10^{-4}$ mol/liter, and most preferably from $3.3\times10^{-3}$ mol/liter to $8.4\times10^{-4}$ mol/liter.

Moreover, the color developers for use in this invention may further contain pH buffers such as carbonates, borates, or phosphates of an alkali metal; preservatives such as hydroxylamine, triethanolamine, the compounds described in West German Patent Application (OLS) No. 2,622,950, sulfites, bisulfites, etc.; organic solvents such as diethylene glycol, etc.; dye-forming couplers; competing couplers; nucleating agents such as sodium borohydride, etc.; auxiliary developing agents such as 1-phenyl-3-pyrazolidone, etc.; viscosity-imparting agents; and chelating agents such as aminopolycarboxylic acids (e.g., ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, and the compounds described in Japanese Patent Application (OPI) No. 195845/83), 1-hydroxyethylidene-1,1'-diphosphonic acid, organic phosphonic acids described in Research Disclosure, No. 18170 (May, 1979), aminophosphonic acids (e.g., aminotris(methylenephosphonic acid, ethylenediamine-N,N,N'-tetramethylenephosphonic acid, etc.), and phosphonocarboxylic acids described in Japanese Patent Application (OPI) Nos. 102726/77, 42730/78, 121127/79, 4024/80, 4025/80, 126241/80, 65955/80, 65956/80, and *Research Disclosure,* No. 18170 (May, 1979).

Also, the color developing bath or tank may be composed of two or more baths and a color developer replenisher may be supplied from the foremost bath or the last bath to shorten the development time and reduce the amount of replenisher.

A silver halide color photographic material is, after color development, usually subjected to bleach processing. The bleach processing may be performed simultaneously with a fix processing (bleach-fix or blix processing) or separately from the fix processing.

As a bleaching agent, compounds of multivalent metals such as iron(III), cobalt(III), chromium(VI), copper(II), etc., peracids, quinones, nitroso compounds, etc., are used. Examples of the bleaching agent include ferricyanides, bichromates, organic complex salts of iron(III) or cobalt(III), complex salts of aminopolycarboxylic acids (e.g., ethylenediaminetetraacetic acid, diethylenetriaminepentaacetic acid, nitrilotriacetic acid, 1,3-diamino-2-propanoltetraacetic acid, etc.) or of other organic acids (e.g., citric acid, tartaric acid, malic acid, etc.), persulfates, manganates, nitrosophenol, etc.

Of the aforesaid compounds, potassium ferricyanide, ethylenediaminetetraacetic acid iron(III) sodium, ethylenediaminetetraacetic acid iron(III) ammonium, triethylenetetraminepentaacetic acid(III) ammonium, and persulfates are particularly useful. Ethylenediaminetetraacetic acid iron(III) complex salts are useful for both bleach solution and blix solution.

Also, the bleach solution or blix solution may further contain, if necessary, various accelerators. Examples of the accelerator are bromide ions and iodide ions as well as thiourea series compounds described in U.S. Pat. No. 3,706,561, Japanese Patent Publication Nos. 8506/70 and 26586/74, Japanese Patent Application (OPI) Nos. 32735/78, 36233/78 and 37016/78, thiol series compounds described in Japanese Patent Application (OPI) Nos. 124424/78, 95631/78, 57831/78, 32736/78, 65732/78, 52534/79, and U.S. Pat. No. 3,893,858, heterocyclic compounds described in Japanese Patent Application (OPI) Nos. 59644/74, 140129/75, 28426/78, 141623/78, 104232/78 and 35727/79, thioether series compounds described in Japanese Patent Application (OPI) Nos. 20832/77, 25064/80 and 26506/80, quaternary amines described in Japanese Patent Application (OPI) No. 84440/73, and thiocarbamoyls described in Japanese Patent Application (OPI) No. 42349/74.

As a fixing agent, there may be mentioned thiosulfates, thiocyanates, thioether series compounds, thioureas, and a large number of iodides but a thiosulfate is generally used.

As preservatives for blix solution or fix solution, sulfites, bisulfites, or carbonyl-bisulfite addition products are preferably used.

After blix process or fix process, washing process is usually performed. For the wash processing step, various compounds may be used for preventing the occurrence of precipitations and saving water. Examples of these additives are water softeners such as inorganic phosphoric acids, aminopolycarboxylic acids and organic phosphoric acids, antibacterial agents and antifungal agents for preventing the generation of bacteria, molds, and algae, hardening agents such as magnesium salts and aluminum salts, and surface active agents for reducing drying load and preventing the occurrence of drying mark. Furthermore, the compounds described in L. E. West, *Photographic Science and Engineering*, Vol. 9, No. 6, (1965), etc., may be added to washing solution.

The addition of a chelating agent and antifungal agent to the washing solution is particularly effective.

Also, for washing process, a multistage (e.g., 2 to 5 stages) countercurrent system can be employed for water saving.

Also, after or in place of a washing process, a multistage countercurrent stabilizing process as described in Japanese Patent Application (OPI) No. 8543/82 may be employed. In the case of employing the stabilizing process, 2 to 9 countercurrent baths are required.

For stabilizing color images formed, various compounds may be added to the stabilizing bath. Examples of such additives include buffers (e.g., borates, metaborates, borax, phosphates, carbonates, potassium hydroxide, sodium hydroxide, aqueous ammonia, monocarboxylic acids, dicarboxylic acids, polycarboxylic acids, etc.) and formalin for controlling the pH of the photographic layers. In addition, water softeners (inorganic phosphoric acids, aminopolycarboxylic acids, organic phosphoric acids, aminopolyphosphonic acids, phosphonocarboxylic acids, etc.), sterilizers (e.g., Proxel, isothiazolone, 4-thiazolylbenzimidazole, halogenated phenolbenzotriazoles, etc.), surface active agents, optical whitening agents, hardening agents, etc., may be added, if desired.

Also, as an agent for controlling the pH of photographic layers after processing, various ammonium salts such as ammonium chloride, ammonium nitrate, ammonium sulfate, ammonium phosphate, ammonium sulfite, ammonium thiosulfate, etc., can be added to the stabilizer.

BEST MODE FOR CARRYING OUT THE INVENTION

The invention will be explained in detail with reference to the following examples.

EXAMPLE 1

The silver halide emulsions used in this invention were prepared as follows.

In the following description, the term "mean grain size" means a mean value of diameters (do) of spheres having the same volume as silver halide grains. Also, the coefficient of deviation is a value obtained by dividing the standard deviation of the diameters (do) by the mean value of the diameters (do). However, when silver halide grains are tabular grains, the coefficient of deviation is defined as the value obtained by dividing the value of the standard deviation of (d) (the diameter of a circle having the same area as the projected area in the case of dispersing the tabuar silver halide grains on a plane) by a mean value of (d) and multiplying the quotient by 100.

[Preparation of Emulsion A (Coefficient of deviation: 8.5%)]

To 900 ml of 3% aqueous gelatin were added 2 ml of the following "solution a" and 15 ml of 1N aqueous $H_2SO_4$, and further 2.0 g of NaCl was dissolved in the mixture. The solution was kept at 65° C. and then 589 ml of 17% aqueous solution of $AgNO_3$ and 589 ml of a solution containing 21.0 g of KBr and 24.1 g of NaCl were added to the mixture under vigorous stirring by a double jet method over a period of 50 minutes. Furthermore, after removing soluble salts by sedimentation, gelatin was added and re-dispersed and the emulsion was chemically sensitized in optimum condition with sodium thiosulfate to provide Emulsion A. The mean grain size of Emulsion A was 0.70 μm and the silver chloride content was 70 mol %.

"Solution a"

1% aqueous solution of the compound

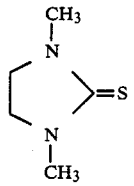

[Preparation of Emulsion B (Coefficient of deviation:9.9%) and Emulsion C (Coefficient of deviation: 9.6%)]

by properly reducing the preparation temperature in the case of preparing Emulsion A described above, Emulsion B having a mean grain size of 0.47 μm and Emulsion C having a mean grain size of 0.42 μm were prepared. The silver chloride content of both Emulsion B and Emulsion C was 70 mol %.

[Preparation of Emulsion D (Coefficient of deviation: 9.3%)]

In 900 ml of 3% aqueous gelatin were dissolved 2 ml of "solution a" described above and 15 ml of 1N aqueous $H_2SO_4$, and further 2.0 g of NaCl was dissolved in the solution. The solution was kept at 67° C. and then 147 ml of 17% aqueous $AgNO_3$ and 147 ml of an aqueous solution containing 7.9 g of KBr and 4.7 g of NaCl were added thereto under vigorous stirring by a double jet method over a period of 12 minutes. Then, 442 ml of 17% aqueous $AgNO_3$ and 442 ml of an aqueous solution containing 13.1 g of KBr and 19.4 g of NaCl were added thereto by a double jet method over a period of 38 minutes. After removing soluble salts by dedimentation, gelatin was added and re-dispersed therein and the emulsion was chemically sensitized in optimum condition with sodium thiosulfate to provide Emulsion D. The mean grain size of Emulsion D was 0.70 μm and the silver chloride content was 70 mol %.

[Preparation of Emulsion E (Coefficient of deviation: 18.0%)]

In 900 ml of 3% aqueous gelatin were dissolved 32.0 g of NaCl and 0.5 g of KBr. The solution was kept at 60° C. and then 22.5 ml of 17% aqueous silver nitrate and 1,000 ml of an aqueous solution containing 27.4 g of KBr and 55.5 g of NaCl were added thereto with vigorous stirring by a double jet method, during which the amount added of the aqueous solution of the halides was adjusted to maintain the initial pAg.

Thereafter, 566.4 ml of an aqueous $AgNO_3$ having the above concentration and an aqueous solution of the alkali halides having the above concentration were added to the aforesaid mixture by a double jet method. In this case, the aqueous $AgNO_3$ was added to the above mixture by accelerated addition such that the added volume per minute v (ml/min) became $4.4+0.138t$ t minutes after the initiation of the addition and also the addition of the aqueous solution of the alkali halides was controlled to maintain the initial pAg.

After removing soluble salts by sedimentation, gelatin was added and redispersed therein and the emulsion obtained was chemically sensitized in optimum condition with sodium thiosulfate to provide Emulsion E. In Emulsion E, tabular grains amounted to 80% of the total projected area of the silver halide grains contained, the mean thickness of the tabular grains was 0.14 μm, and the mean aspect ratio thereof was 6. Also, the mean grain size of Emulsion E was 0.70 μm and the silver chloride content was 77 mol %.

]Preparation of Emulsion F (Coefficient of deviation: 19.5%)]

Emulsion F was obtained by repeating the same procedure as for Emulsion E except that the amounts of NaCl and KBr added to 3% aqueous gelatin were properly changed and pAg was increased. The mean grain size of Emulsion F was 0.70 μm and the silver chloride content thereof was 63 mol %.

[Preparation of Emulsion G (Coefficient of deviation: 17.6%) and Emulsion H (Coefficient of deviation: 18.3%)]

Emulsion G having a mean grain size of 0.47 μm and Emulsion H having a mean grain size of 0.42 μm were obtained by repeating the same procedure as for Emulsion E except that the preparation temperature was lowered, the added amounts of NaCl and KBr to 3% aqueous gelatin were changed, and pAg was increased. The silver chloride content of both Emulsion G and Emulsion H was 70 mol %.

Emulsions used for comparison in this example were prepared as follows.

[Preparation of Emulsion I (Coefficient of deviation: 8.9%)]

In 900 ml of 3% aqueous gelatin were dissolved 2 ml of "solution a" described above and 15 ml of 1N aqueous $H_2SO_4$ and further 5.5 g of NaCl was dissolved in the solution. The solution was kept at 72° C. and then 59 ml of 17% aqueous solution and 59 ml of an aqueous solution containing 5.6 g of KBr and 0.7 g of NaCl were added thereto with vigorous stirring by a double jet method over a period of 20 minutes. Thereafter, 530 ml of 17% aqueous $AhNO_3$ and 530 ml of an aqueous solution containing 50.4 g of KBr and 6.2 g of NaCl were added thereto by a double jet method over a period of 50 minutes. Furthermore, after removing soluble salts by sedimentation, gelatin was added and redispersed therin and the emulsion was chemically sensitized in optimum condition with sodium thiosulfate to provide Emulsion I. The mean grain size of Emulsion I was 0.70 μm and the silver chloride content was 20 mol %.

[Preparation of Emulsion J (Coefficient of deviation: 10.3%)]

Emulsion J was prepared by repeating the same procedure as for Emulsion A except that 589 ml of an aqueous solution containing 35.1 of KBr and 17.2 g of NaCl was used in place of the aqueous solution of the halides added by double jet method and the preparation temperature was changed to 68° C. The mean grain size of Emulsion J was 0.70 μm and the silver chloride content thereof was 50 mol %.

[Preparation of Emulsion K (Coefficient of deviation: 9.8%) and Emulsion L (Coefficient of deviation: 0.6%)]

By lowering the preparation temperture employed in the preparation of Emulsion J, Emulsion K having a mean grain size of 0.47 μm and Emulsion L having a mean grain size of 0.42 μm were prepared. The silver chloride content of both Emulsion K and Emulsion L was 50 mol %. [Preparation of Emulsion M (Coefficient of deviation: 12.1%)]

Emulsion M was prepared by repeating the same procedure as for Emulsion D except that 147 ml of an aqueous solution containing 11.4 g of KBr and 3.0 g of NaCl was used in place of the aqueous solution of halides added in the 1st step, 442 ml of an aqueous solution containing 23.6 g of KBr and 14.2 g of NaCl was used in place of the aqueous solution of halides added in the 2nd step, and the preparation temperature was changed to 70° C.

The mean grain size of Emulsion M was 0.70 μm and the silver chloride content was 50 mol %.

[Preparation of Emulsion N (Coefficient of deviation: 9.5%)]

Emulsion N was prepared by repeating the same procedure as for Emulsion A except that 589 ml of an aqueous solution containing 7.0 g of KBr and 31.0 g of NaCl was used in place of the aqueous solution of halides added by double jet method and the preparation temperature was changed to 55° C. The mean grain size of Emulsion N was 0.70 μm and the silver chloride content was 90 mol %.

The properties of Emulsion A to H for use in this invention are shown in Table 1 below and the properties of Comparison Emulsions I to N are shown in Table 2 below. In addition, Emulsions E, F, G and H differed from each other in the mean grain size of tabular grains and the silver chloride content as shown in Table 1 but were the same in other profiles.

In the above-described preparation of each emulsions, at the time of the end of the chemical sensitization, spectral sensitization was performed by the addition of spectral senesitizing dyes. The king of silver halide emulsion and the combination of spectral sensitizing dyes with the emulsions are described hereinafter.

For each emulsion layer of the color photographic material, the following dyes were used as irradiation preventing dyes.

For Green-Sensitive Emulsion Layer:

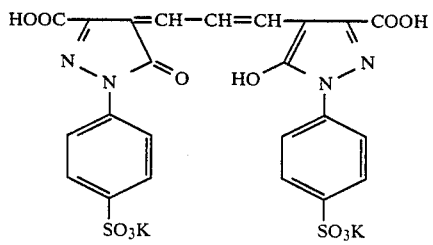

For Red-Sensitive Emulsion Layer:
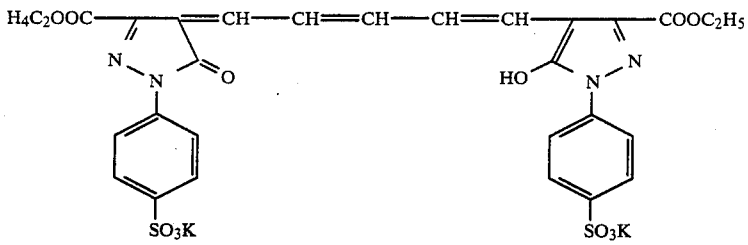
The structural formulae of the compounds used for the couplers, etc., were as follows.
Yellow Coupler (a)
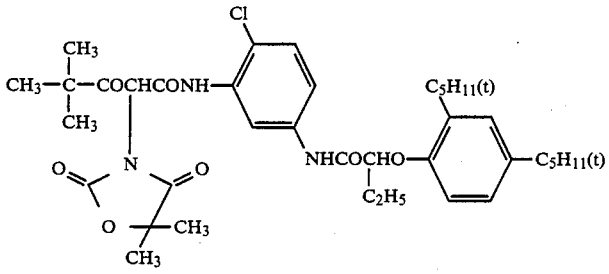
Color Image Stabilizer (b)
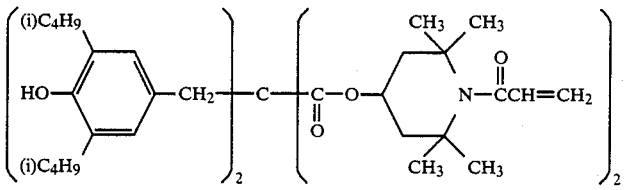
Solvent (c)
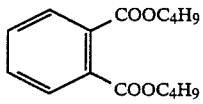
(d)
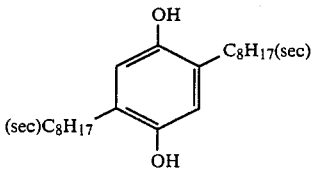
Magenta Coupler (M-50) (e)

-continued
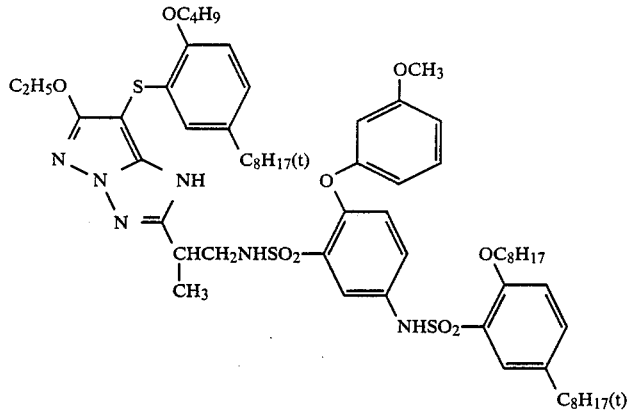
Color Image Stabilizer (f)
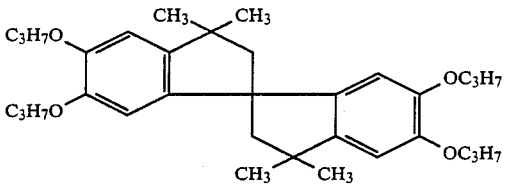
Solvent (g)
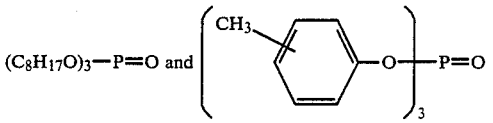
2:1 mixture (weight ratio)
Ultraviolet Absorber (h)
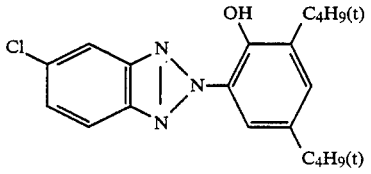
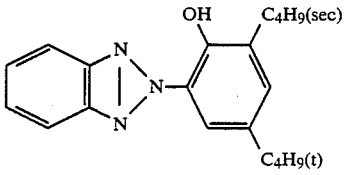
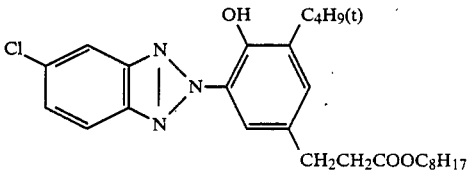
1:5:3 mixture (mol ratio)
Color Mixing Preventing Agent (i)

-continued
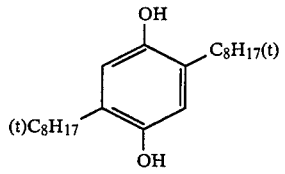
Solvent (j)
$(iso C_9H_{18}O)_3P{=}O$
Cyan Coupler (k)
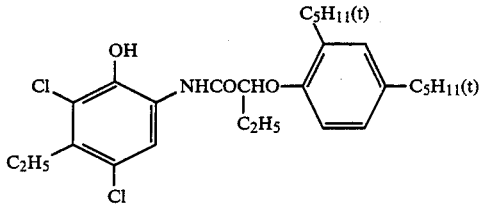
(K1)
and
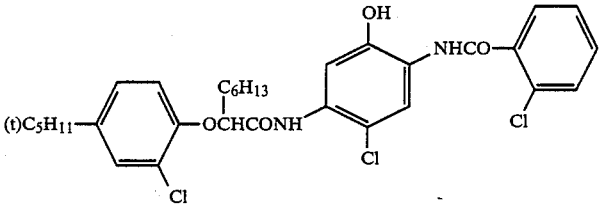
(K2)
1:1 mixture (mol ratio)
Color Image Stabilizer (l)
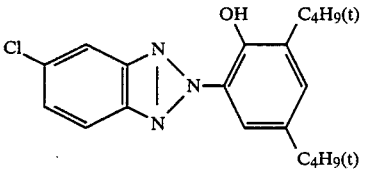
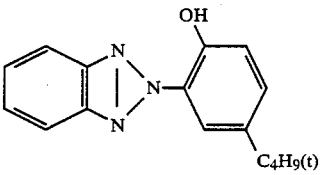
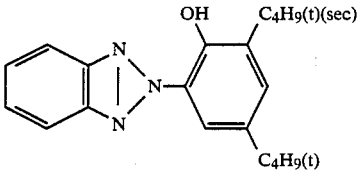
1:3:3 mixture (mol ratio)
Solvent (m)

-continued

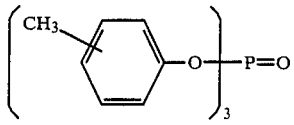

TABLE 1

| Layer | Main Components | Amount Used |
|---|---|---|
| Layer 7 (Protective Layer) | Gelatin | 1.33 g/m$^2$ |
| | Acryl-modified copolymer of polyvinyl alcohol (modification degree: 17%) | 0.17 g/m$^2$ |
| Layer 6 (Ultraviolet Absorptive Layer) | Gelatin | 0.54 g/m$^2$ |
| | Ultraviolet Absorber (h) | 0.21 g/m$^2$ |
| | Solvent (i) | 0.09 ml/m$^2$ |
| Layer 5 (Red-Sensitive Emulsion | Silver Chlorobromide Emulsion (silver bromide: 70 mol %) | 0.26 g/m$^2$ (as silver) |
| | Gelatin | 0.98 g/m$^2$ |
| | Cyan Coupler (k) | 0.38 g/m$^2$ |
| | Color Image Stabilizer (l) | 0.17 g/m$^2$ |
| | Solvent (m) | 0.23 ml/m$^2$ |
| Layer 4 (Ultraviolet Absorptive Layer) | Gelatin | 1.60 g/m$^2$ |
| | Ultraviolet Absorber (h) | 0.62 g/m$^2$ |
| | Color Mixing Preventing Agent (i) | 0.05 g/m$^2$ |
| | Solvent (j) | 0.26 ml/m$^2$ |
| Layer 3 (Green-Sensitive | Silver Chlorobromide Emulsion (silver bromide: 75 mol %) | 0.16 g/m$^2$ (as silver) |

TABLE 1-continued

| Layer | Main Components | Amount Used |
|---|---|---|
| | Magenta Coupler (e) | 0.43 g/m$^2$ |
| | Color Image Stabilizer (f) | 0.20 g/m$^2$ |
| | Solvent (g) | 0.68 ml/m$^2$ |
| Layer 2 (Color Mixing Preventing Layer) | Gelatin | 0.99 g/m$^2$ |
| | Color Mixing Preventing Agent (d) | 0.08 g/m$^2$ |
| Layer 1 (Blue-Sensitive Emulsion Layer) | Silver Chlorobromide Emulsion (silver bromide: 80 mol %) | 0.30 g/m$^2$ (as silver) |
| | Gelatin | 1.86 g/m$^2$ |
| | Yellow Coupler (a) | 0.71 g/m$^2$ |
| | Color Image Stabilizer (b) | 0.19 g/m$^2$ |
| | Solvent (c) | 0.34 ml/m$^2$ |
| Support | Polyethylene-coated paper (polyethylene layer of the emulsion-carrying side contains a white pigment ($TiU_2$) and a bluish dye (ultramarine) | |

Thus, Samples (1) to (13) were prepared in the manner described above. The silver halide emulsions and sensitizing dyes used for these samples are shown in Table 4 below.

TABLE 4

| | | Sample No. | | | | | | | | | | | | |
|---|---|---|---|---|---|---|---|---|---|---|---|---|---|---|
| | | (1) | (2) | (3) | (4) | (5) | (6) | (7) | (8) | (9) | (10) | (11) | (12) | (13) |
| Layer 5 (Red-Sensitive Emulsion Layer) | Emulsion No. | C | C | C | C | C | C | C | H | L | L | L | L | L |
| | Compound No. (Spectral Sensitizer) | Comparison-3 | III-10 | IV-1 | IV-2 | IV-1 | IV-1 | IV-1 | IV-1 | IV-1 | IV-1 | IV-1 | IV-1 | Comparison-3 |
| Layer 3 (Green-Sensitive Emulsion Layer) | Emulsion No. | B | B | B | B | B | B | B | G | K | K | K | K | K |
| | Compound No. (Spectral Sensitizer) | Comparison-2 | II-3 | II-2 | II-8 | II-2 | II-2 | II-2 | II-2 | II-2 | II-2 | II-2 | II-2 | Comparison-2 |
| Layer 1 (Blue-Sensitive Emulsion Layer) | Emulsion No. | A | A | A | A | D | E | F | D | I | J | M | N | J |
| | Compound No. (Spectral Sensitizer) | Comparison-1 | I-2 | I-1 | I-10 | I-1 | I-1 | I-1 | I-1 | I-1 | I-1 | I-1 | I-1 | Comparison-1 |

Sample Nos. (1), (9)–(13): Comparison samples
Sample Nos. (2)–(8): Samples of this invention

| | | |
|---|---|---|
| Emulsion Layer) | Gelatin | 1.80 g/m$^2$ |

Comparison 1, Comparison 2, and Comparison 3 shown above as comparison compounds in Table 4 are as follows.

(Comparison 1)

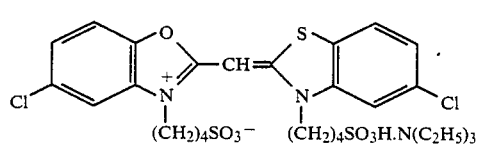

(Comparison 2)

-continued

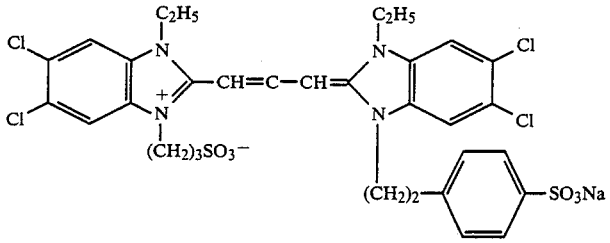

(Comparison 3)

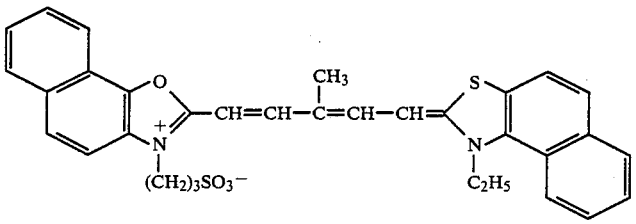

Each of Samples (1) to (13) described above was subjected to sensitometric gradation exposure through each of blue filter, green filter and red filter using a sensitometer (Type FWH with color temperature of the light source 3,200° K., made by Fuji Photo Film Co., Ltd.). In this case, the exposure was effected so as to give the exposure of 250 CMS by 0.5 sec exposure.

Thereafter, the experiments of Processing A and Processing B were conducted using Color Developer (A) or Color Developer (B) as shown below.

Each Processing included color development, blix and washing processes and the development time was set to 2 minutes. The contents of Processings A and B show the difference between Color Developers (A) and (B) and other processing contents are the same in A and B.

| Processing Step | Temperature | Time |
|---|---|---|
| Color Development | 36° C. | 2.0 min |
| Blix | 36° C. | 1.0 min |
| Washing | 28–35° C. | 3.0 min |

(Preparation of Developer)

Color Developer (A):

| | |
|---|---|
| Diethylenetriaminepentaacetic Acid.5Na | 2.0 g |
| Benzyl Alcohol | 15 ml |
| Diethylene Glycol | 10 ml |
| $Na_2SO_3$ | 2.0 g |
| KBr | 0.5 g |
| Hydroxylamine Sulfate | 3.0 g |
| 4-Amino-3-methyl-N-ethyl-N-[β-(methanesulfonamido)ethyl]-p-phenylenediamine.Sulfate | 5.0 g |
| $Na_2CO_3$ (monohydrate) | 30.0 g |
| Optical Whitening Agent (stilbene series) | 1.0 g |
| Water to make | 1,000 ml (pH 10.2) |

Color Developer (B):

| | |
|---|---|
| Diethylenetriaminepentaacetic Acid.5Na | 2.0 g |
| $Na_2SO_3$ | 2.0 g |
| KBr | 0.5 g |
| Hydroxylamine Sulfate | 3.0 g |
| 4-Amino-3-methyl-N-ethyl-N-[β-(methanesulfonamido)ethyl]-p-phenylenediamine.Sulfate | 5.0 g |
| $Na_2CO_3$ (monohydrate) | 30.0 g |
| Optical Whitening Agent (stilbene series) | 1.0 g |
| Water to make | 1,000 ml (pH 10.2) |

-continued

| (Preparation of Blix Solution) (common to Processings A and B) | |
|---|---|
| Ammonium Thiosulfate (54% by weight) | 150 ml |
| $Na_2SO_3$ | 15 g |
| $NH_4[Fe(III)(EDTA)]$ | 55 g |
| EDTA.2Na | 4 g |
| Water to make | 1,000 ml (pH 6.9) |

The results obtained are shown in Table 5 below.

The relative sensitivity in Processing B referred to in Table 5 means a relative value of each sensitivity of each light-sensitive emulsion layer of Samples (1) to (13) taking the sensitivity in Processing A as 100. The sensitivity is expressed by a relative value of the reciprocal of the exposure necessary for giving the density of the minimum density plus 0.5. Also, as a measure for knowing the extent of the reduction in the color density due to Processing B, a color density obtained by Processing B at the exposure giving a density of 1.5 in the case of performing Processing A was used. Accordingly, it may be said that as a color photographic magerial gives the color density resulting from Processing B closer to 1.5, it colors more efficiently.

Furthermore, the values of fog in the case of performing Processing B are also shown in Table 5 together with those in the case of performing Processing A.

TABLE 5

| Sample No. | Layer | Relative sensitivity in Processing B | Color Density in Processing B | Fog in Processing B (Fog in Processing A) |
|---|---|---|---|---|
| (1) | B | 87 | 1.27 | 0.14 (0.15) |
| | G | 91 | 1.37 | 0.16 (0.18) |
| | R | 89 | 1.30 | 0.15 (0.17) |
| (2) | B | 93 | 1.37 | 0.10 (0.11) |
| | G | 98 | 1.47 | 0.12 (0.13) |
| | R | 95 | 1.43 | 0.11 (0.13) |
| (3) | B | 95 | 1.41 | 0.09 (0.11) |
| | G | 100 | 1.48 | 0.12 (0.14) |
| | R | 98 | 1.47 | 0.11 (0.12) |
| (4) | B | 95 | 1.40 | 0.10 (0.11) |
| | G | 98 | 1.46 | 0.12 (0.13) |
| | R | 95 | 1.44 | 0.12 (0.14) |

TABLE 5-continued

| Sample No. | Layer | Relative sensitivity in Processing B | Density in Processing B | Fog in Processing B (Fog in Processing A) |
|---|---|---|---|---|
| (5) | B | 98 | 1.47 | 0.10 (0.11) |
| | G | 98 | 1.48 | 0.12 (0.14) |
| | R | 98 | 1.46 | 0.11 (0.13) |
| (6) | B | 100 | 1.49 | 0.11 (0.12) |
| | G | 100 | 1.48 | 0.12 (0.13) |
| | R | 95 | 1.42 | 0.12 (0.14) |
| (7) | B | 93 | 1.39 | 0.09 (0.11) |
| | G | 98 | 1.47 | 0.12 (0.14) |
| | R | 95 | 1.44 | 0.12 (0.13) |
| (8) | B | 98 | 1.46 | 0.10 (0.12) |
| | G | 93 | 1.41 | 0.12 (0.14) |
| | R | 93 | 1.40 | 0.11 (0.13) |
| (9) | B | 62 | 0.95 | 0.09 (0.10) |
| | G | 85 | 1.24 | 0.12 (0.13) |
| | R | 83 | 1.25 | 0.12 (0.14) |
| (10) | B | 81 | 1.12 | 0.10 (0.11) |
| | G | 85 | 1.23 | 0.12 (0.14) |
| | R | 85 | 1.27 | 0.11 (0.13) |
| (11) | B | 83 | 1.15 | 0.10 (0.12) |
| | G | 83 | 1.19 | 0.12 (0.13) |
| | R | 83 | 1.24 | 0.11 (0.12) |
| (12) | B | 100 | 1.47 | 0.17 (0.22) |
| | G | 85 | 1.22 | 0.12 (0.14) |
| | R | 85 | 1.25 | 0.11 (0.13) |
| (13) | B | 74 | 1.02 | 0.13 (0.14) |
| | G | 79 | 1.10 | 0.14 (0.16) |
| | R | 81 | 1.13 | 0.13 (0.15) |

Sample Nos. (1), (9)-(13): Comparison Samples
Sample Nos. (2)-(8): Samples of this invention From the results of Table 5 above, it can be seen that in the combination of this invention, even when Processing B is performed using no benzyl alcohol, the reduction in relative sensitivity is less, coloring properties are excellent, and the formation of fog is less. Also, it can be seen that when a silver chloride content is less than 60%, the development is delayed and the color density is reduced, which results in reducing the relative sensitivity, while when a silver chloride content is over 80 mol %, the formation of fog is suddenly increased.

EXAMPLE 2

By following the same procedure as in Example 1 except that the materials shown in Table 6 below were used, Samples (14) to (18) were prepared.

Samples (14) to (18) were exposed and processed as in Example 1 and the photographic properties thereof were evaluated. The photographic properties were evaluated about color density only. The results are shown in Table 7 below.

TABLE 6

| | | Sample No. (14) | (15) | (16) | (17) | (18) |
|---|---|---|---|---|---|---|
| Layer 5 (Red-Sensitive Emulsion Layer) | Emulsion No. | C | C | C | C | |
| | Compound No. (Spectral Sensitizer) | IV-1 | IV-1 | IV-1 | IV-1 | * |
| | Coupler No. | k | k | k | k | |
| Layer 3 (Green-Sensitive Emulsion Layer) | Emulsion No. | B | B | B | B | B |
| | Compound No. (Spectral Sensitizer) | II-2 | II-2 | II-2 | II-2 | II-2 |
| | Coupler No. | M-47 | M-96 | M-55 | Comparison-4 | M-50 |
| Layer 1 (Blue-Sensitive Emulsion Layer) | Emulsion No. | A | A | A | A | |
| | Compound No. (Spectral Sensitizer) | I-1 | I-1 | I-1 | I-1 | * |
| | Coupler No. | a | a | a | a | |

Sample Nos. (14)-(16): Samples of this invention
Sample Nos. (17) and (18): Comparison samples
*Sample (18) is the same as Sample (3) wherein, however, Layer 1 was replaced with the red-sensitive layer and Layer 5 was replaced with the blue-sensitive layer.

Comparison 4 used as comparison compound in Table 6 above is as follows.

(Comparison 4)

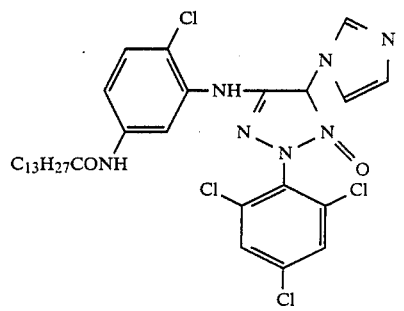

TABLE 7

| Sample No. | Layer | Color Density in Processing B | Remarks |
|---|---|---|---|
| | B | 1.42 | |
| (14) | G | 1.49 | Pyrazoloazole |
| | R | 1.47 | |
| | B | 1.41 | |
| (15) | G | 1.43 | Pyrazoloazole |
| | R | 1.46 | |
| | B | 1.41 | |
| (16) | G | 1.50 | Pyrazoloazole |
| | R | 1.47 | |
| | B | 1.40 | |
| (17) | G | 1.33 | 5-Pyrazolone |
| | R | 1.46 | |
| | B | 1.46 | Layer 5 |
| (18) | G | 1.48 | Pyrazoloazole |
| | R | 1.45 | Layer 1 |

From the results shown in Table 7 above, it can be seen that when the magenta coupler shown by general is used as a magenta coupler to be contained in a green-sensitive emulsion layer, the color density is far increased.

INDUSTRIAL APPLICABILITY

By the practice of this invention, a stable and rapid processing becomes possible with less formation of fog. Also, by using the color image-forming process of this invention, the use of benzyl alcohol is substantially eliminated in processing steps for color prints, whereby the load for pollution is reduced and the preparation of processing solutions is simplified. In addition, the reduction of color density due to cyan dyes remaining as leuco compounds can be prevented.

Accordingly, by utilizing this invention, a large amount of color prints can be rapidly processed and the productivity can be greatly increased.

Furthermore, the color prints obtained by the color image forming process of this invention are excellent in whiteness owing to less fog, which results in giving good final quality with good clearing.

We claim:

1. A color image-forming process, which comprises, after imagewise exposing a silver halide color photographic material having on a reflective support at least one each of a blue-sensitive emulsion layer, a green-sensitive emulsion layer and a red-sensitive emulsion layer.

said blue-sensitive emulsion layer containing a monodisperse silver chlorobromide emulsion spectrally sensitized by Compound I-1, I-2 or I-10, (I-1)

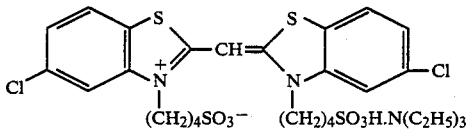

(I-2)

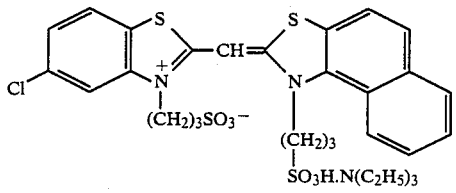

(I-10)

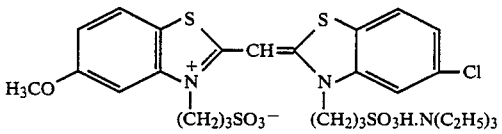

said green sensitive emulsion layer containing a monodispersed silver chlorobromide emulsion spectrally sensitized by Compound II-2, II-3 or II-8, and (II-2)

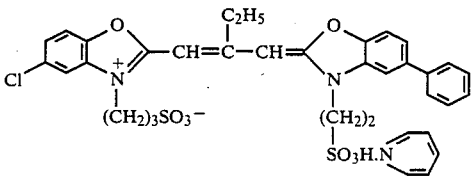

-continued (II-3)

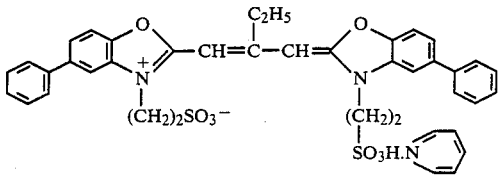

(II-8)

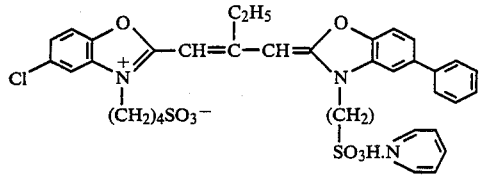

said red-sensitive emulsion layer containing a monodispersed silver chlorobromide emulsion spectrally sensitized by Compound IV-1 or IV-2

(IV-1)

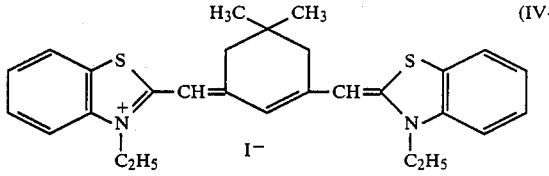

(IV-2)

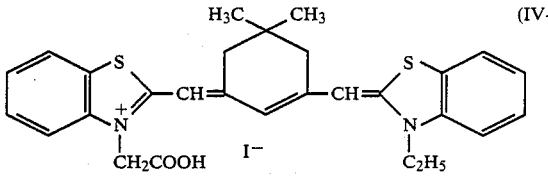

and these layers each containing substantially no silver iodide, containing silver chloride in an amount of from 60 mol % to less than 80 mol % of the total silver halide amount and having a coefficient of deviation of not more than 20%, developing the color photographic material using a color developer wherein the concentration of benzlyl alcohol is 1 ml/1 or less within a development time of 2 minutes and 30 seconds.

2. The color image-forming process according to claim 1, wherein the green light-sensitive emulsion layer containing the monodispersed silver chlorobromide emulsion spectrally sensitized by Compound II-2, II-3 or II-8 contains at least one of the compounds represented by general formula (V):

(V)

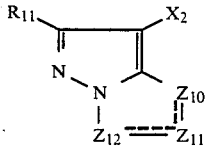

wherein $R_{11}$ represents a hydrogen atom or a substituent;

$X_2$ represents a hydrogen atom or a group capable of being released by a coupling reaction with the oxidation product of an aromatic primary amine developing agent;

$Z_{10}$, $Z_{11}$ and $Z_{12}$ each represents methine, a substituted methine, =N—, or —NH—; and one of the $Z_{10}$–$Z_{11}$ bond and the $Z_{11}$–$Z_{12}$ bond is a double bond and the other is a single bond, when $Z_{11}$—$Z_{12}$ is a carbon-carbon double bond, the double bond may be a part of an aromatic ring; the compound of general formula (V) includes formation of a dimer or higher polymer at $R_{11}$ or $X_2$; and when $Z_{10}$, $Z_{12}$ or $Z_{12}$ is substituted ethine, and the compound of general formula (v) includes formation of a dimer or higher polymer at the substituted methine.

3. The color image-forming process described in claim 1 to 3, wherein the silver chloride content of the monodispersed silver chlorobromide emulsion is from 65 mol % to 78 mol % of the total silver halide.

4. The color image-forming process described in claim 1 to 3, wherein the coefficient of deviation of the monodispersed silver chlorobromide emulsion is 15% or less.

5. The color image-forming process described in claims 1 to 3, wherein the coefficient of deviation of the monodispersed silver chlorobromide emulsion is not more than 10%.

6. The color image-forming process described in claims 1 to 3, wherein the mean grain size of the silver halides in the monodispersed silver chlorobromide emulsion is from 0.03 $\mu m^3$ to 2 $\mu m^3$ as calculated in volume.

7. The color image-forming process according to claim 2, wherein the compounds represented by general formula (V) are compounds represented by the following general formula (VI), (VII), (VIII), (IX), (X) or (XI):

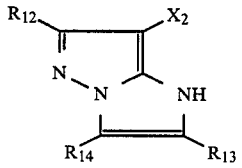

(VI)

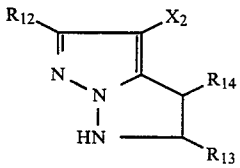

(VII)

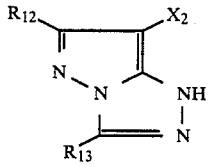

(VIII)

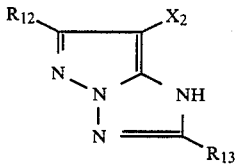

(IX)

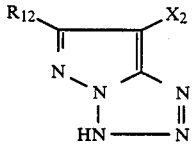

(X)

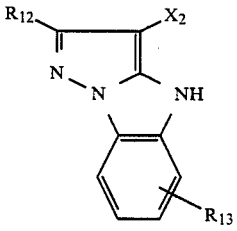

(XI)

wherein $R_{12}$, $R_{13}$ and $R_{14}$ each represents a hydrogen a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; $X_2$ represents a hydrogen atom, a halogen atom, a carboxyl group, or a group which is bonded to a carbon atom at the coupling position through an oxygen atom, a nitrogen atom or a sulfur atom and causes coupling releasing; the compound includes said $R_{12}$, $R_{13}$, $R_{14}$ or $X_2$ being a divalent group, and the compound forming a bis compound by the divalent group; and when the moiety shown by general formulae (VI) to (XI) is bonded to a vinyl monomer, $R_{12}$, $R_{13}$ or $R_{14}$ represents a simple bond or a linking group, through which the moiety shown by general formulae (VI) to (XI) is bonded to said vinyl monomer.

8. The color image-forming process according to claim 7, wherein the compounds shown by general formula (V) are compounds shown by general formula (VIII) or (IX), at least one of $R_{12}$ and $R_{13}$ of the formula is an unsubstituted or substituted alkyl group, and said group is bonded to the pyrazoloazole skeleton through a secondary or tertiary carbon atom thereof.

9. The color image-forming process described in claim 8, wherein said unsubstituted or substituted alkyl group is directly bonded to the secondary or tertiary carbon atom.

10. The color image-forming process described in claim 9, wherein said substituted alkyl group is a sulfonamidoalkyl group, a sulfonamidoarylalkyl group, or a sulfonylalkyl group.

11. The color image-forming process described in claim 2, wherein the compounds shown by general formula (V) are compounds represented by the following general formula (XII) or (XIII):

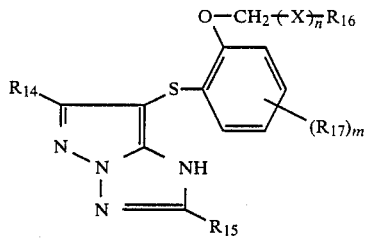

(XII)

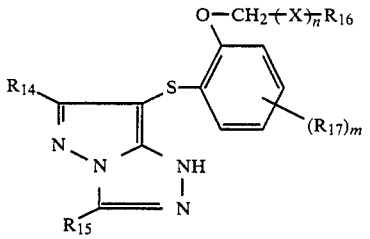

(XIII)

wherein $R_{14}$ and $R_{15}$ each represents a hydrogen atom, a halogen atom, a alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; at least one of said $R_{14}$ and $R_{15}$ is a group bonded to the pyrazoloazole skeleton through a nitrogen atom, an oxygen atom, or a sulfur atom; X represents $-CH_2-O-$, $-CH_2O-CH_2CH_2-$, $-CH_2SO_2-$, $-CH_2CH_2CH_2SO_2NH-$, $-CH_2CH_2CH_2SO_2NHCH_2CH_2O-$, $-CH_2CH_2CONH-$, $-CH_2-COOO-$, $-CH_2CONH-$, $-CH_2CH_2CH_2CONH-$, $-CH_2CH_2SO_2-$, $-CH_2CH_2SO_2NH-$, $-CH_2CH_2NHSO_2-$, $-CH_2NHCO-$, $-CH_2CH_2NHCO-$, $$-\underset{\underset{O}{\|}}{C}-O-,\ -\underset{\underset{O}{\|}}{C}-,$$

$-SO_2-$, $-SO_2NH-$,

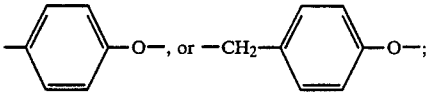

$R_{16}$ represents an alkyl group or an aryl group; $R_{17}$ represents a halogen atom, an alkoxy group, an alkyl group, an aryl group, a hydroxyl group, a cyano group, an amino group, an N-alkylamino group, an N,N-dialkylamino group, an N-anilino group, an acylamino group, a ureido group, an alkoxycarbonylamino group, an imido group, a sulfonamido group, a sulfamoyl group, an alkoxycarbonyl group; a carbamoyl group, an acyl group, or an alkylthio group; n represents 0 or 1; and m represents an integer of from 0 to 4; when m is 2 or more, $R_{17}$s may be the same or different.

12. The color image-forming process according to claim 11, wherein $R_{14}$ in general formula (XII) is an alkoxy group, a ureido group or an aryloxy group.

13. The color image-forming process according to claim 11, wherein $R_{15}$ in general formula (XII) is an unsubstituted or substituted alkyl group.

14. The color image-forming process according to claim 11, wherein $R_{14}$ in general formula (XIII) is an alkyl group or an alkoxy group and $R_{15}$ is an alkylthio group.

15. The color image-forming process according to claims 1 to 2, wherein the color developer contains no benzyl alcohol.

16. The color image-forming process according to claims 1 to 2, wherein the color developing time is from 30 seconds to 2 minutes.

17. The color image-forming process according to claims 1 to 2, wherein the color developer contains an aromatic primary amine color developing agent.

18. The color image-forming process according to claim 17, wherein the aromatic primary amine color developing agent is a p-phenylenediamine series color developing agent.

19. The color image-forming process according to claim 18, wherein the p-phenylenediamine series color developing agent is 3-methyl-4-amino-N-ethyl-N-β-hydroxy- ethylaniline or 3-methyl-4-μmino-N-ethyl-N-β-methanesulfonamidoethylaniline.

20. The color image-forming process according to claim 18, wherein the p-phenylenediamine series color developing agent is 3-methyl-4-amino-N-ethyl-N-βmethanesulfonamidoethylaniline.

* * * * *